US010794159B2

(12) United States Patent
Eitschberger et al.

(10) Patent No.: US 10,794,159 B2
(45) **Date of Patent: *Oct. 6, 2020**

(54) BOTTOM-FIRE PERFORATING DRONE

(71) Applicant: DynaEnergetics Europe GmbH, Troisdorf (DE)

(72) Inventors: Christian Eitschberger, Munich (DE); Liam McNelis, Bonn (DE); Thilo Scharf, Letterkenny (IE); Andreas Robert Zemla, Much (DE); Shmuel Silverman, Novato, CA (US); Gernot Uwe Burmeister, Austin, TX (US); Arash Shahinpour, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/451,440

(22) Filed: Jun. 25, 2019

(65) Prior Publication Data

US 2019/0368321 A1 Dec. 5, 2019

Related U.S. Application Data

(63) Continuation-in-part of application No. PCT/US2019/027383, filed on Apr. 12, 2019, and a (Continued)

(51) Int. Cl.

| | |
|---|---|
| ***E21B 43/1185*** | (2006.01) |
| ***E21B 43/117*** | (2006.01) |
| ***E21B 47/095*** | (2012.01) |

(52) U.S. Cl.

CPC ..... *E21B 43/1185* (2013.01); *E21B 43/117* (2013.01); *E21B 47/095* (2020.05)

(58) Field of Classification Search

CPC ..... E21B 43/11; E21B 43/116; E21B 43/117; E21B 43/1185; E21B 43/119

See application file for complete search history.

(56) References Cited

U.S. PATENT DOCUMENTS

| | | | |
|---|---|---|---|
| 2,062,974 | A | 12/1936 | Lane |
| 2,418,486 | A | 4/1947 | Smylie |

(Continued)

FOREIGN PATENT DOCUMENTS

| | | | |
|---|---|---|---|
| AR | 021476 | A1 | 7/2002 |
| CA | 2941648 | A1 | 9/2015 |

(Continued)

OTHER PUBLICATIONS

International Search Report and Written Opinion of International App. No. PCT/EP2019/066919, dated Sep. 10, 2019, which is in the same family as U.S. Appl. No. 16/451,440, 11 pgs.

(Continued)

*Primary Examiner* — Jennifer H Gay
(74) *Attorney, Agent, or Firm* — Moyles IP, LLC

(57) ABSTRACT

According to some embodiments, a bottom-fire perforating drone for downhole delivery of a wellbore tool, and associated systems and methods, are disclosed. In an aspect, the wellbore tool may be a plurality of shaped charges that are arranged in a variety of configurations, including helically and in one or more single radial planes around a perforating assembly section, and detonated in a bottom-up sequence when the bottom-fire perforating drone reaches a predetermined depth in the wellbore. In another aspect, the shaped charges may be received in shaped charge apertures within a body of a perforating assembly section, wherein the shaped charge apertures are respectively positioned adjacent to at least one of a receiver booster, detonator, and detonating cord for directly initiating the shaped charges.

20 Claims, 19 Drawing Sheets

Related U.S. Application Data continuation-in-part of application No. PCT/US2019/025024, filed on Mar. 29, 2019, and a continuation-in-part of application No. PCT/US2019/022799, filed on Mar. 18, 2019, and a continuation-in-part of application No. 16/272,326, filed on Feb. 11, 2019, now Pat. No. 10,458,213.

(60) Provisional application No. 62/842,329, filed on May 2, 2019, provisional application No. 62/831,215, filed on Apr. 9, 2019, provisional application No. 62/827,468, filed on Apr. 1, 2019, provisional application No. 62/823,737, filed on Mar. 26, 2019, provisional application No. 62/816,649, filed on Mar. 11, 2019, provisional application No. 62/780,427, filed on Dec. 17, 2018, provisional application No. 62/765,185, filed on Aug. 20, 2018, provisional application No. 62/699,484, filed on Jul. 17, 2018, provisional application No. 62/690,314, filed on Jun. 26, 2018, provisional application No. 62/678,636, filed on May 31, 2018.

(56) References Cited

U.S. PATENT DOCUMENTS 2,734,456 A 2/1956 Sweetman
2,785,631 A 3/1957 Blanchard
2,946,283 A 7/1960 Udry
3,013,491 A 12/1961 Poulter
3,173,992 A 3/1965 Boop
3,565,188 A 2/1971 Hakala
4,007,796 A 2/1977 Boop
4,140,188 A 2/1979 Vann
4,266,613 A 5/1981 Boop
4,290,486 A * 9/1981 Regalbuto ..... E21B 29/02 102/312
4,312,273 A 1/1982 Camp
4,496,008 A 1/1985 Pottier et al.
4,523,650 A 6/1985 Sehnert et al.
4,534,423 A 8/1985 Regalbuto
4,598,775 A * 7/1986 Vann ..... E21B 43/117 102/310
4,609,057 A 9/1986 Walker et al.
4,619,333 A 10/1986 George
4,621,396 A 11/1986 Walker et al.
4,650,009 A 3/1987 McClure et al.
4,657,089 A * 4/1987 Stout ..... E21B 43/117 102/318
4,739,839 A 4/1988 Regalbuto et al.
4,747,201 A 5/1988 Donovan et al.
4,753,170 A 6/1988 Regalbuto et al.
4,790,383 A 12/1988 Savage et al.
4,800,815 A 1/1989 Appledom et al.
4,850,438 A 7/1989 Regalbuto
5,007,486 A 4/1991 Ricles
5,027,708 A 7/1991 Gonzalez et al.
5,159,145 A 10/1992 Carisella et al.
5,223,665 A 6/1993 Burleson et al.
5,392,860 A 2/1995 Ross
5,603,384 A * 2/1997 Bethel ..... E21B 43/11855 175/4.54
5,648,635 A 7/1997 Lussier et al.
5,775,426 A 7/1998 Snider et al.
5,785,130 A 7/1998 Wesson et al.
5,816,343 A 10/1998 Markel et al.
5,837,925 A 11/1998 Nice
5,992,289 A * 11/1999 George ..... E21B 43/11855 166/297
6,006,833 A 12/1999 Burleson et al.
6,182,765 B1 2/2001 Kilgore
6,216,596 B1 4/2001 Wesson
6,298,915 B1 * 10/2001 George ..... E21B 43/119 166/255.2
6,333,699 B1 12/2001 Zierolf
6,412,415 B1 7/2002 Kothari et al.
6,439,121 B1 8/2002 Gillingham
6,487,973 B1 12/2002 Gilbert, Jr. et al.
6,497,285 B2 12/2002 Walker
6,779,605 B2 8/2004 Jackson
6,843,317 B2 * 1/2005 Mackenzie ..... E21B 44/005 166/254.2
7,044,230 B2 5/2006 Starr et al.
7,093,664 B2 8/2006 Todd et al.
7,168,494 B2 1/2007 Starr et al.
7,217,917 B1 5/2007 Tumlin et al.
7,278,491 B2 10/2007 Scott
7,322,416 B2 1/2008 Burris, II et al.
7,347,279 B2 3/2008 Li et al.
7,353,879 B2 4/2008 Todd et al.
7,441,601 B2 10/2008 George et al.
7,735,578 B2 6/2010 Loehr et al.
7,752,971 B2 7/2010 Loehr
7,762,351 B2 7/2010 Vidal
7,775,279 B2 8/2010 Marya et al.
8,056,632 B2 11/2011 Goodman
8,066,083 B2 11/2011 Hales et al.
8,074,737 B2 12/2011 Hill et al.
8,127,846 B2 * 3/2012 Hill ..... E21B 23/14 166/153
8,141,434 B2 3/2012 Kippersund et al.
8,151,882 B2 4/2012 Grigar et al.
8,327,746 B2 12/2012 Behrmann et al.
8,413,727 B2 4/2013 Holmes
8,505,632 B2 8/2013 Guerrero et al.
8,596,378 B2 12/2013 Mason et al.
8,863,665 B2 10/2014 DeVries et al.
8,875,787 B2 11/2014 Tassaroli
8,881,816 B2 11/2014 Glenn et al.
8,904,935 B1 12/2014 Brown et al.
8,950,480 B1 2/2015 Strickland
8,981,957 B2 3/2015 Gano et al.
9,062,539 B2 6/2015 Schmidt et al.
9,133,695 B2 9/2015 Xu
9,145,748 B1 9/2015 Meier et al.
9,157,718 B2 10/2015 Ross
9,194,219 B1 * 11/2015 Hardesty ..... F42D 1/05
9,206,675 B2 12/2015 Hales et al.
9,284,819 B2 * 3/2016 Tolman ..... E21B 23/00
9,284,824 B2 3/2016 Fadul et al.
9,317,038 B2 4/2016 Ozick et al.
9,328,577 B2 5/2016 Hallundbaek et al.
9,359,863 B2 6/2016 Streich et al.
9,382,783 B2 7/2016 Langford et al.
9,383,237 B2 7/2016 Wiklund et al.
9,441,470 B2 9/2016 Guerrero et al.
9,464,508 B2 10/2016 Lerche et al.
9,476,289 B2 10/2016 Wells
9,494,021 B2 11/2016 Parks et al.
9,523,255 B2 12/2016 Andrzejak
9,574,416 B2 2/2017 Wright et al.
9,581,422 B2 2/2017 Preiss et al.
9,605,937 B2 3/2017 Eitschberger et al.
9,677,363 B2 6/2017 Schacherer et al.
9,689,223 B2 6/2017 Schacherer et al.
9,702,680 B2 7/2017 Parks et al.
9,784,549 B2 10/2017 Eitschberger
9,790,763 B2 10/2017 Fripp et al.
9,797,238 B2 10/2017 Frosell et al.
9,903,192 B2 * 2/2018 Entchev ..... E21B 43/263
9,926,755 B2 3/2018 Van Petegem et al.
9,963,955 B2 5/2018 Tolman et al.
10,000,994 B1 6/2018 Sites
10,001,007 B2 6/2018 Pelletier et al.
10,053,968 B2 8/2018 Tolman et al.
10,066,921 B2 9/2018 Eitschberger
10,077,641 B2 9/2018 Rogman et al.
10,138,713 B2 * 11/2018 Tolman ..... E21B 23/10
10,301,910 B2 5/2019 Whitsitt et al.
10,352,144 B2 * 7/2019 Entchev ..... E21B 43/263
10,458,213 B1 10/2019 Eitschberger et al.
2004/0216632 A1 11/2004 Finsterwald
2004/0239521 A1 12/2004 Zierolf

(56) References Cited

U.S. PATENT DOCUMENTS

2005/0194146 A1 9/2005 Barker et al.
2005/0229805 A1* 10/2005 Myers, Jr. ..... E21B 17/042 102/275
2005/0269083 A1 12/2005 Burris, II et al.
2007/0125540 A1* 6/2007 Gerez ..... E21B 43/116 166/298
2007/0267195 A1* 11/2007 Grigar ..... E21B 43/1185 166/297
2008/0110612 A1 5/2008 Prinz et al.
2008/0121095 A1 5/2008 Plan et al.
2008/0134922 A1 6/2008 Grattan et al.
2008/0149338 A1 6/2008 Goodman et al.
2008/0264639 A1 10/2008 Parrott et al.
2009/0159285 A1* 6/2009 Goodman ..... E21B 43/1185 166/297
2009/0183916 A1 7/2009 Pratt et al.
2010/0000789 A1* 1/2010 Barton ..... E21B 43/1185 175/2
2010/0096131 A1* 4/2010 Hill ..... E21B 23/14 166/285
2010/0163224 A1* 7/2010 Strickland ..... E21B 33/12 166/254.1
2011/0024116 A1 2/2011 McCann et al.
2012/0085538 A1 4/2012 Guerrero et al.
2012/0152542 A1 6/2012 Le
2012/0160491 A1 6/2012 Goodman et al.
2012/0180678 A1 7/2012 Kneisl
2012/0241169 A1 9/2012 Hales et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli
2013/0048376 A1 2/2013 Rodgers et al.
2013/0062055 A1* 3/2013 Tolman ..... E21B 23/00 166/250.01
2013/0118805 A1 5/2013 Moody-Stuart et al.
2013/0153205 A1 6/2013 Borgfeld et al.
2013/0199843 A1* 8/2013 Ross ..... F42C 15/188 175/4.54
2013/0248174 A1* 9/2013 Dale ..... E21B 23/00 166/255.1
2014/0131035 A1* 5/2014 Entchev ..... E21B 43/263 166/255.1
2014/0138090 A1* 5/2014 Hill ..... E21B 43/1185 166/297
2014/0218207 A1 8/2014 Gano et al.
2015/0041124 A1 2/2015 Rodriguez
2015/0176386 A1* 6/2015 Castillo ..... E21B 43/26 166/250.1
2015/0226044 A1 8/2015 Ursi et al.
2015/0275615 A1 10/2015 Rytlewski et al.
2015/0330192 A1 11/2015 Rogman et al.
2015/0354310 A1 12/2015 Zaiser
2015/0376991 A1 12/2015 McNelis et al.
2016/0040520 A1 2/2016 Tolman et al.
2016/0061572 A1* 3/2016 Eitschberger ..... F42C 19/12 89/1.15
2016/0069163 A1* 3/2016 Tolman ..... E21B 23/10 166/297
2016/0084048 A1 3/2016 Harrigan et al.
2016/0108722 A1 4/2016 Whitsitt et al.
2016/0168961 A1 6/2016 Parks et al.
2016/0258240 A1 9/2016 Fripp et al.
2016/0273902 A1* 9/2016 Eitschberger ..... F42D 1/05
2016/0290098 A1 10/2016 Marya
2016/0356132 A1 12/2016 Burmeister et al.
2017/0030693 A1 2/2017 Preiss et al.
2017/0052011 A1 2/2017 Parks et al.
2017/0058649 A1 3/2017 Geerts et al.
2017/0145798 A1 5/2017 Robey et al.
2017/0167233 A1 6/2017 Sampson et al.
2017/0175500 A1 6/2017 Robey et al.
2017/0199015 A1 7/2017 Collins et al.
2017/0211363 A1* 7/2017 Bradley ..... F42B 3/08
2017/0241244 A1 8/2017 Barker et al.
2017/0268326 A1 9/2017 Tao et al.
2017/0268860 A1 9/2017 Eitschberger
2017/0275976 A1 9/2017 Collins et al.
2017/0314372 A1* 11/2017 Tolman ..... E21B 33/134
2017/0357021 A1 12/2017 Valero et al.
2018/0003045 A1 1/2018 Dotson et al.
2018/0030334 A1 2/2018 Collier et al.
2018/0087369 A1 3/2018 Sherman et al.
2018/0135398 A1* 5/2018 Entchev ..... E21B 43/263
2018/0209251 A1 7/2018 Robey et al.
2018/0274342 A1 9/2018 Sites
2018/0299239 A1* 10/2018 Eitschberger ..... F42D 1/045
2018/0306010 A1 10/2018 Von Kaenel et al.
2018/0318770 A1 11/2018 Eitschberger et al.
2018/0340412 A1 11/2018 Singh et al.
2019/0040722 A1* 2/2019 Yang ..... E21B 43/117
2019/0048693 A1* 2/2019 Henke ..... E21B 43/1185
2019/0049225 A1 2/2019 Eitschberger
2019/0085685 A1* 3/2019 McBride ..... G01V 3/28
2019/0195054 A1* 6/2019 Bradley ..... F42C 19/0838
2019/0211655 A1 7/2019 Bradley et al.
2019/0284889 A1* 9/2019 Lagrange ..... E21B 43/116
2019/0292887 A1* 9/2019 Austin, II ..... E21B 43/117
2019/0316449 A1* 10/2019 Schultz ..... E21B 47/101
2019/0368321 A1* 12/2019 Eitschberger ..... E21B 43/1185
2019/0368331 A1 12/2019 Vick, Jr. et al.
2020/0018139 A1* 1/2020 Eitschberger ..... E21B 43/1185

FOREIGN PATENT DOCUMENTS

CN 201620848 U 11/2010
EP 1688584 B1 8/2011
EP 2952675 A2 9/2015
GB 2548101 A 9/2017
RU 2633904 C1 10/2017
WO 2011146866 A2 11/2011
WO 2011150251 A1 12/2011
WO WO-2012006357 A2 * 1/2012 ..... E21B 43/116
WO 2012161854 A2 11/2012
WO 2015134719 A1 9/2015
WO 2017147329 A1 8/2017
WO 2018009223 A1 1/2018
WO 2018067598 A1 4/2018
WO 2018177733 A1 10/2018
WO 2018182565 A1 10/2018
WO 2019148009 A2 8/2019

OTHER PUBLICATIONS

International Searching Authority, International Search Report and Written Opinion of International App. No. PCT/IB2019/000537, which is in the same family as U.S. Appl. No. 16/451,440, dated Sep. 25, 2019, 18 pgs.
International Searching Authority, International Search Report and Written Opinion of International App. No. PCT/IB2019/000526, which is in the same family as U.S. Appl. No. 16/451,440, dated Sep. 25, 2019, 17 pgs.
Wade et al., Field Tests Indicate New Perforating Devices Improve Efficiency in Casing Completion Operations, SPE 381, pp. 1069-1073, Oct. 1962, 5 pgs.
SIPO, Search Report dated Mar. 29, 2017, in Chinese: See Search Report for CN App No. 2014800404569, dated Jul. 11, 2017, 12 pgs.
World Intellectual Property Office, Search Report for GB Patent App. No. GB1700625.5, dated Jul. 11, 2017, dated Jul. 7, 2017, 5 pages.
GB Intellectual Property Office, Office Action dated Feb. 27, 2018, See Office Action for App. No. GB 1717516.7, dated Jul. 11, 2017, 6 pgs.
Norwegian Industrial Property Office, Office Action for NO Patent App. No. 20160017, dated Jul. 11, 2017, dated Jun. 15, 2017, 3 pgs.
Norwegian Industrial Property Office, Search Report for NO Patent App. No. 20160017, dated Jul. 11, 2017, dated Jun. 15, 2017, 2 pgs.
FIIP, Search Report dated Feb. 1, 2018, in Russian: See Search Report for RU App. No. 2016104882/03, dated Jul. 11, 2017, 7 pgs.

(56) References Cited

OTHER PUBLICATIONS

International Search Report of International Application No. PCT/CA2014/050673, dated Jul. 11, 2017, dated Oct. 9 2014, 3 pgs.
Amit Govil, Selective Perforation: A Game Changer in Perforating Technology—Case Study, presented at the 2012 European and West African Perforating Symposium, 14 pgs.
UK Examination Report of United Kingdom Patent Application No. GB1600085.3, dated Jul. 11, 2017, dated Mar. 9, 2016, 1 pg.
International Written Opinion of International Application No. PCT/CA2014/050673, dated Jul. 11, 2017, dated Oct. 9, 2014, 4 pgs.
Jet Research Centers, Capsule Gun Perforating Systems, Alvarado, Texas, 26 pgs., https://www.jetresearch.com/content/dam/jrc/Documents/Books_Catalogs/07_Cap_Gun.pdf.
Hunting, Gun Systems and Accessories, 1 pg., http://www.hunting-intl.com/media/1976277/Wireline%20Capsule%20Gun%20Accessories.pdf.
Harrison Jet Gun Xtra Penetrator, website visited Nov. 29, 2018, 1 pg., https://www.google.com/search?q=harrison+jet+gun+xtra+penetrator&client=firefox-b-1-d&source=lnms&tbm=isch&sa=X&ved=0ahUKEwjY0KOQ1YTJAhXHmeAKHa00DeYQ_AUIESgC&biw=1440&bih=721#imgrc=ZlqpUcJ_-TL3IM.
International Search Report and Written Opinion of International App. No. PCT/EP2019/072032, dated Nov. 15, 2019, 1 pgs.
Dalia Abdallah et al., Casing Corrosion Measurement to Extend Asset Life, Dec. 31, 2013, 14 pgs., https://www.slb.com/-/media/files/oilfield-review/2-casing-corr-2-english.
United States Patent and Trademark Office, Non-final Office Action of U.S. Appl. No. 16/585,790, dated Nov. 12, 2019, 9 pgs.
United States Patent and Trademark Office, Non-final Office Action of U.S. Appl. No. 16/455,816, dated Nov. 5, 2019, 17 pgs.
United States Patent and Trademark Office, Final Office Action of U.S. Appl. No. 16/423,230, dated Nov. 4, 2019, 14 pgs.
United States Patent and Trademark Office, Non-final Office Action of U.S. Appl. No. 16/542,890, which is related to U.S. Appl. No. 16/451,440, dated Nov. 4, 2019, 16 pgs.
International Searching Authority, International Search Report and Written Opinion of International App. No. PCT/IB2019/000530, which is in the same family as U.S. Appl. No. 16/451,440, dated Oct. 8, 2019, 13 pgs.
Ivntemational Search Report and Written Opinion of International App. No. PCT/EP2019/072064, dated Nov. 20, 2019, which is in the same family as U.S. Appl. No. 16/451,440, 15 pgs.
United States Patent and Trademark Office, Non Final Office Action of U.S. Appl. No. 16/455,816, which is in the same family as U.S. Appl. No. 16/451,440, dated Jan. 13, 2020, 14 pgs.
Entchev et al., "Autonomous Perforating System for Multizone Completions," SPE 147296, Prepared for Presentation at Society of Petroleum Engineers (SPE) Annual Technical Conference and Exhibition held Oct. 30, 2011-Nov. 2, 2011, 7 pgs.
United States Patent and Trademark Office, Final Office Action of U.S. Appl. No. 16/542,890, which is in the same family as U.S. Appl. No. 16/451,440, dated May 12, 2020, 16 pgs.
International Searching Authority, International Search Report and Written Opinion of International App. No. PCT/EP2020/058241, dated Aug. 10, 2020, 18 pgs.

* cited by examiner

BOTTOM-FIRE PERFORATING DRONE

CROSS-REFERENCE TO RELATED APPLICATIONS

This application claims the benefit of U.S. Provisional Patent Application No. 62/842,329, filed May 2, 2019. This application claims the benefit of U.S. Provisional Patent Application No. 62/816,649, filed Mar. 11, 2019. This application claims priority to International Patent Application No. PCT/IB2019/000526, filed Apr. 12, 2019, which claims priority to International Patent Application No. PCT/IB2019/000537, filed Mar. 18, 2019, which claims the benefit of U.S. Provisional Patent Application No. 62/678,636 filed May 31, 2018. This application claims priority to International Patent Application No. PCT/IB2019/000530 filed Mar. 29, 2019, which claims the benefit of U.S. Provisional Patent Application No. 62/690,314 filed Jun. 26, 2018, to which this application also claims the benefit. This application claims the benefit of U.S. Provisional Patent Application No. 62/765,185 filed Aug. 16, 2018. This application claims priority to U.S. patent application Ser. No. 16/272,326 filed Feb. 11, 2019, which claims the benefit of U.S. Provisional Patent Application No. 62/780,427 filed Dec. 17, 2018 and U.S. Provisional Patent Application No. 62/699,484 filed Jul. 17, 2018, to which this application also claims the benefit. This application claims the benefit of U.S. Provisional Patent Application No. 62/823,737 filed Mar. 26, 2019. This application claims the benefit of U.S. Provisional Patent Application No. 62/827,468 filed Apr. 1, 2019. This application claims the benefit of U.S. Provisional Patent Application No. 62/831,215 filed Apr. 9, 2019. The entire contents of each application listed above are incorporated herein by reference.

BACKGROUND OF THE DISCLOSURE

Hydraulic Fracturing (or, "fracking") is a commonly-used method for extracting oil and gas from geological formations (i.e., "hydrocarbon bearing formations") such as shale and tight-rock formations. Fracking typically involves, among other things, drilling a wellbore into a hydrocarbon bearing formation; installing casing(s) and tubing; deploying a perforating gun including shaped explosive charges in the wellbore via a wireline or other methods; positioning the perforating gun within the wellbore at a desired area; perforating the wellbore and the hydrocarbon formation by detonating the shaped charges; pumping high hydraulic pressure fracking fluid into the wellbore to force open perforations, cracks, and imperfections in the hydrocarbon formation; delivering a proppant material (such as sand or other hard, granular materials) into the hydrocarbon formation to hold open the perforations, fractures, and cracks (giving the tight-rock formation permeability) through which hydrocarbons flow out of the hydrocarbon formation; and, collecting the liberated hydrocarbons via the wellbore.

Perforating the wellbore and the hydrocarbon formations is typically done using one or more perforating guns. For example, as shown in FIG. 1, a conventional perforating gun string 1100 may have two or more perforating guns 1110. Each perforating gun 1110 may have a substantially cylindrical gun barrel 1120 housing a charge carrier 1130 including, among other things, one more shaped charges 1140, a detonating cord 1150 for detonating the shaped charges 1140, and a conductive line 1160 for relaying an electrical signal between connected perforating guns 1110.

Shaped charges 1140 in the perforating gun 1110 are typically detonated in a "top-fire" sequence from a topmost shaped charge 1141 to a bottommost shaped charge 1142. For purposes of this disclosure, "topmost" means furthest "upstream," or towards the well surface, and "bottommost" means furthest "downstream," or further from the surface within the well. The top-fire sequence is initiated by a detonator 1145 positioned nearest the topmost shaped charge 1141. The top-fire sequence may be problematic for any perforating gun or wellbore tool that is detonated while traveling at high speed, because the velocity of the tool and the wellbore fluid combined with the force from detonating a topmost explosive charge may separate and scatter different portions of the tool. This may decrease accuracy in perforating at particular locations, cause failure of explosive charges or other components, result in greater amounts of debris, and the like. In addition, it is generally more favorable for the deployment and physical conveyance for pump down operations of the wellbore tool if most of the weight of the tool (i.e., the detonator and associated control components) is at the front (downstream end) of the tool in relation to its direction of movement.

FIG. 1B shows a cross-sectional view of a wellbore and wellhead according to the prior art use of a wireline cable 2012 to place drones in a wellbore 2016. In oil and gas wells, the wellbore 2016, as illustrated in FIG. 1B is a narrow shaft drilled in the ground, vertically and/or horizontally deviated. A wellbore 2016 can include a substantially vertical portion as well as a substantially horizontal portion and a typical wellbore may be over a mile in depth (e.g., the vertical portion) and several miles in length (e.g., the horizontal portion). The wellbore 2016 is usually fitted with a wellbore casing that includes multiple segments (e.g., about 40-foot segments) that are connected to one another by couplers. A coupler (e.g., a collar), may connect two sections of wellbore casing.

In the oil and gas industry, the wireline cable 2012, electric line or e-line are cabling technology used to lower and retrieve equipment or measurement devices into and out of the wellbore 2016 of an oil or gas well for the purpose of delivering an explosive charge, evaluation of the wellbore 2016 or other well-related tasks. Other methods include tubing conveyed (i.e., TCP for perforating) slickline or coil tubing conveyance. A speed of unwinding the wireline cable 2012 and winding the wireline cable 2012 back up is limited based on a speed of the wireline equipment 2062 and forces on the wireline cable 2012 itself (e.g., friction within the well). Because of these limitations, it typically can take several hours for a wireline cable 2012 and a toolstring 2031 to be lowered into a well and another several hours for the wireline cable 2012 to be wound back up and the expended toolstring retrieved. The wireline equipment 2062 feeds wireline 2012 through wellhead 2060. When detonating explosives, the wireline cable 2012 will be used to position the toolstring 2031 of perforating guns 2018 containing the explosives into the wellbore 2016. After the explosives are detonated, the wireline cable 2012 will have to be extracted or retrieved from the well.

Wireline cables and TCP systems have other limitations such as becoming damaged after multiple uses in the wellbore due to, among other issues, friction associated with the wireline cable rubbing against the sides of the wellbore. Location within the wellbore is a simple function of the length of wireline cable that has been sent into the well. Thus, the use of wireline may be a critical and very useful component in the oil and gas industry yet also presents significant engineering challenges and is typically quite time consuming. It would therefore be desirable to provide a system that can minimize or even eliminate the use of wireline cables for activity within a wellbore while still enabling the position of the downhole equipment, e.g., the toolstring 2031, to be monitored.

During many critical operations utilizing equipment disposed in a wellbore, it is important to know the location and depth of the equipment in the wellbore at a particular time. When utilizing a wireline cable for placement and potential retrieval of equipment, the location of the equipment within the well is known or, at least, may be estimated depending upon how much of the wireline cable has been fed into the wellbore. Similarly, the speed of the equipment within the wellbore is determined by the speed at which the wireline cable is fed into the wellbore. As is the case for a toolstring 2031 attached to a wireline, determining depth, location and orientation of a toolstring 2031 within a wellbore 2016 is typically a prerequisite for proper functioning.

One known means of locating a toolstring 2031, whether tethered or untethered, within a wellbore involves a casing collar locator ("CCL") or similar arrangement, which utilizes a passive system of magnets and coils to detect increased thickness/mass in a wellbore casing 1580 (FIG. 7) at portions where coupling collars 1590 (FIG. 7) connect two sections of wellbore casing 1582, 1584 (FIG. 7). A toolstring 2031 equipped with a CCL may be moved through a portion of the wellbore casing 1580 having the collar 1590. The increased wellbore wall thickness/mass the collar 1590 results in a distortion of the magnetic field (flux) around the CCL magnet. This magnetic field distortion, in turn, results in a small current being induced in a coil; this induced current is detected by a processor/onboard computer which is part of the CCL. In a typical embodiment of known CCL, the computer 'counts' the number of coupling collars 1590 detected and calculates a location along the wellbore 2016 based on the running count.

Another known means of locating a toolstring 2031 within a wellbore 2016 involves tags attached at known locations along the wellbore casing 1580. The tags, e.g., radio frequency identification ("RFID") tags, may be attached on or adjacent to casing collars but placement unrelated to casing collars is also an option. Electronics for detecting the tags are integrated with the toolstring 2031 and the onboard computer may 'count' the tags that have been passed. Alternatively, each tag attached to a portion of the wellbore may be uniquely identified. The detecting electronics may be configured to detect the unique tag identifier and pass this information along to the computer, which can then determine current location of the toolstring 2031 along the wellbore 2016.

Similar operations and challenges may be encountered with downhole delivery, deployment, and/or initiation of a variety of wellbore tools besides perforating guns. For example, a wellbore tool may be a puncher gun, logging tool, jet cutter, plug, frac plug, bridge plug, setting tool, self-setting bridge plug, self-setting frac plug, mapping/positioning/orientating tool, bailer/dump bailer tool, or other ballistic tool. For purposes of this disclosure, a wellbore tool is any such tool, listed or otherwise, that is delivered, deployed, or initiated in a wellbore, and the disclosed exemplary embodiments are not limited to any particular wellbore tool.

Accordingly, current wellbore operations and system(s) require substantial amounts of onsite personnel and equipment. Even with large gun strings, a substantial amount of time, equipment, and labor may be required to deploy the perforating gun or wellbore tool string, position the perforating gun or wellbore tool string at the desired location(s), and retrieve the fired perforating gun assemblies post perforating. Further, current perforating devices and systems may be made from materials that remain in the wellbore after detonation of the shaped charges and leave a large amount of debris that must either be removed from the wellbore or left within. Accordingly, devices, systems, and methods that may reduce the time, equipment, labor, and debris associated with downhole operations would be beneficial.

Knowledge of the location, depth and velocity of the toolstring in the absence of a wireline cable would be essential. The present disclosure is further associated with systems and methods of determining location along a wellbore 2016 that do not necessarily rely on the presence of casing collars or any other standardized structural element, e.g., tags, associated with the wellbore casing 1580.

BRIEF DESCRIPTION OF THE EXEMPLARY EMBODIMENTS

The exemplary embodiments relate generally to a bottom-fire perforating drone for downhole delivery of one or more wellbore tools, comprising: a perforating assembly section; a control module section including a hollow interior portion and a ballistic channel respectively positioned within the control module section, wherein the ballistic channel extends from the hollow interior portion in a direction towards the perforating assembly section; a control module positioned within the hollow interior portion of the control module section, wherein the control module includes a housing and the housing encloses a donor charge within an inner area of the control module, and the donor charge is positioned adjacent to the ballistic channel; and a receiver booster positioned within the ballistic channel.

In a further aspect, the exemplary embodiments relate to a method for perforating a wellbore casing or hydrocarbon formation, comprising: arming a bottom-fire perforating drone, wherein the bottom-fire perforating drone includes a perforating assembly section, a control module section including a hollow interior portion and a ballistic channel respectively positioned within the control module section, wherein the ballistic channel extends from the hollow interior portion in a direction towards the perforating assembly section, a control module positioned within the hollow interior portion of the control module section, wherein the control module includes a housing and the housing encloses a detonator and a donor charge within a detonator channel within an inner area of the control module, wherein the detonator is in ballistic communication with the donor charge and configured to initiate the donor charge upon detonating, and the donor charge is positioned adjacent to the ballistic channel, a receiver booster positioned within the ballistic channel, a ballistic interrupt positioned within the ballistic channel between the donor charge and the receiver booster in a spaced apart configuration from the donor charge and the receiver booster, wherein the ballistic interrupt is movable between a closed state and an open state, wherein arming the bottom-fire perforating drone includes moving the ballistic interrupt from the closed state to the open state, and at least one shaped charge received in a shaped charge aperture in a body of the perforating assembly section; deploying the bottom-fire perforating drone into the wellbore; and detonating the at least one shaped charge.

In a still further aspect, the exemplary embodiments relate to a bottom-fire perforating drone for downhole delivery of one or more wellbore tools, comprising: a perforating assembly section; a control module section including a hollow interior portion and a ballistic channel respectively positioned within the control module section, wherein the ballistic channel extends from the hollow interior portion into at least a portion of a body portion of the perforating assembly section; a control module positioned within the hollow interior portion of the control module section, and a donor charge housed within the control module and substantially aligned with the ballistic channel; a receiver booster positioned at least in part within the portion of the ballistic channel within the body portion of the perforating assembly section; a first plurality of shaped charges received in a first plurality of shaped charge apertures in the body portion of the perforating assembly section, wherein the first plurality of shaped charge apertures are arranged in a first single radial plane and an initiation end of each of the first plurality of shaped charges is substantially adjacent to the receiver booster when the respective shaped charges are received in the respective shaped charge apertures; and a second plurality of shaped charges received in a second plurality of shaped charge apertures in the body portion of the perforating assembly section, wherein the second plurality of shaped charge apertures are arranged in a second single radial plane, wherein the second single radial plane is positioned upstream of the first single radial plane, and an initiation end of each of the second plurality of shaped charges is substantially adjacent to the receiver booster when the respective shaped charges are received in the respective shaped charge apertures.

For purposes of this disclosure, a "drone" is a self-contained, autonomous or semi-autonomous vehicle for downhole delivery of a wellbore tool. A "bottom-fire perforating drone" according to some embodiments is a drone in which, e.g., shaped charges carried by the drone are detonated in a bottom-up, i.e., downstream to upstream, sequence along the drone. However, as the disclosure makes clear, a "bottom-fire perforating drone" is not limited to a drone for downhole delivery of shaped charges or downhole delivery of wellbore tools that require sequenced initiation.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1A:
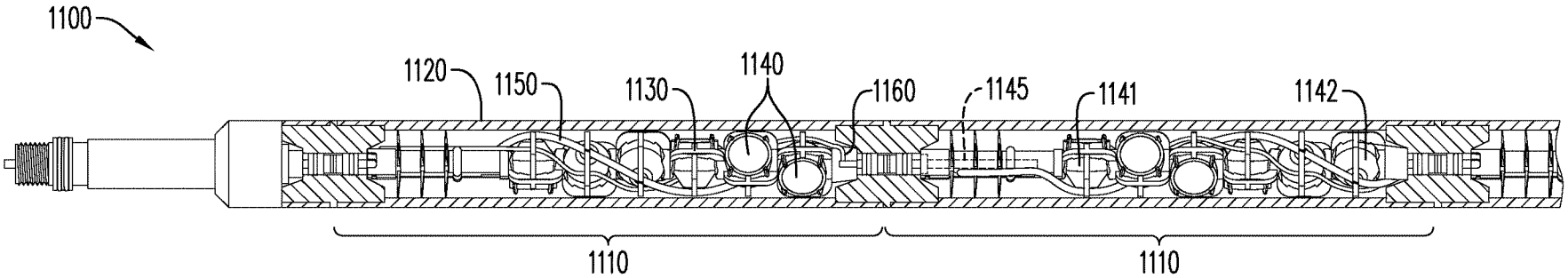
FIG. 1A (PRIOR ART)
FIG. 1A is a cross-sectional view of a perforating gun string according to the prior art.
Figure 1B:
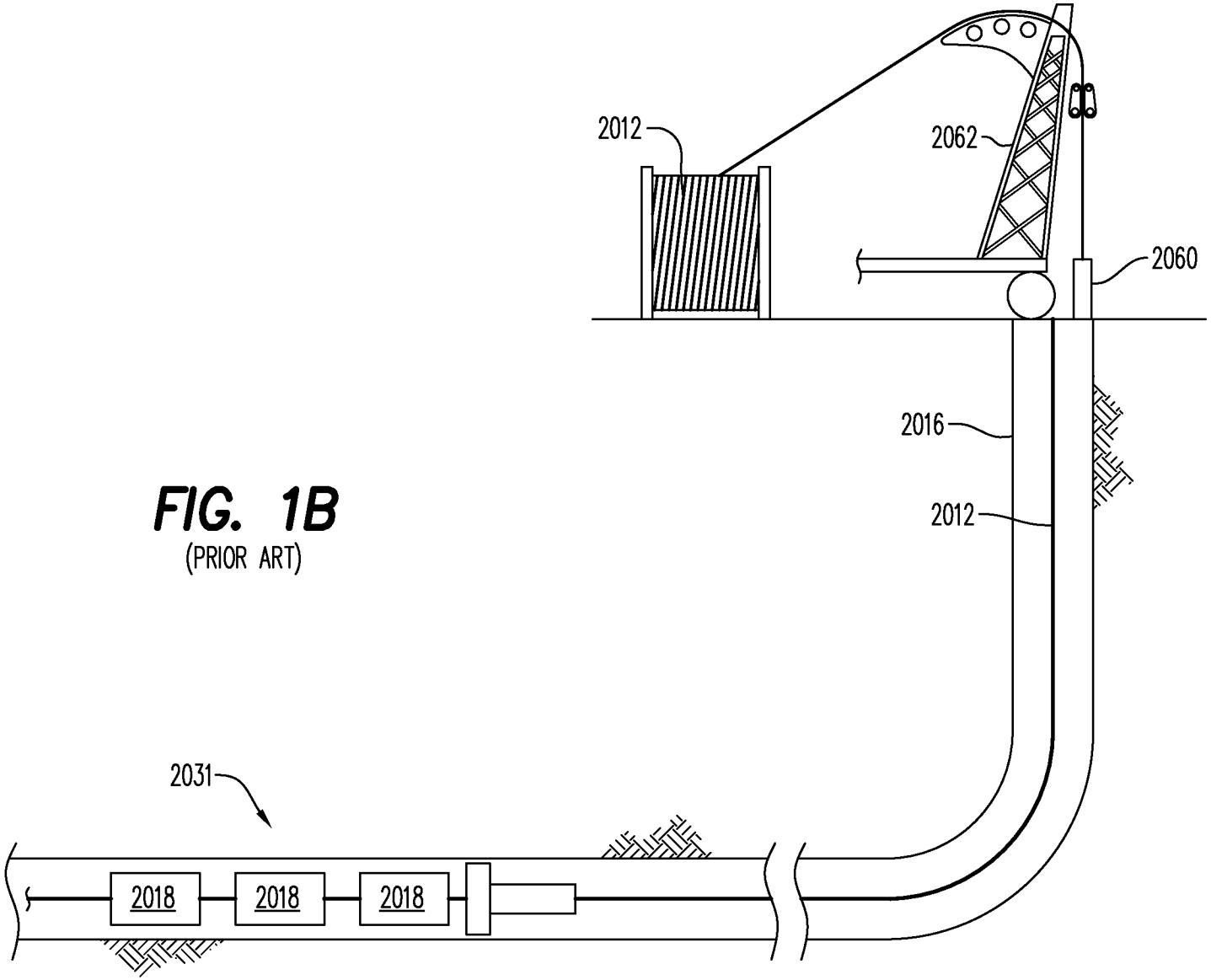
FIG. 1B (PRIOR ART)
FIG. 1B is a cross-sectional view of a wellbore and wellhead showing the prior art use of a wireline to place drones in a wellbore.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

This application incorporates by reference each of the following pending patent applications in their entireties: International Patent Application No. PCT/US2019/063966, filed May 29, 2019; U.S. patent application Ser. No. 16/423,230, filed May 28, 2019; U.S. Provisional Patent Application No. 62/841,382, filed May 1, 2019; U.S. Provisional Patent Application No. 62/720,638, filed Aug. 21, 2018; U.S.

Provisional Patent Application No. 62/719,816, filed Aug. 20, 2018; U.S. Provisional Patent Application No. 62/678,654, filed May 31, 2018.

Reference will now be made in detail to various exemplary embodiments. Each example is provided by way of explanation and is not meant as a limitation and does not constitute a definition of all possible embodiments.

Figure 2A:
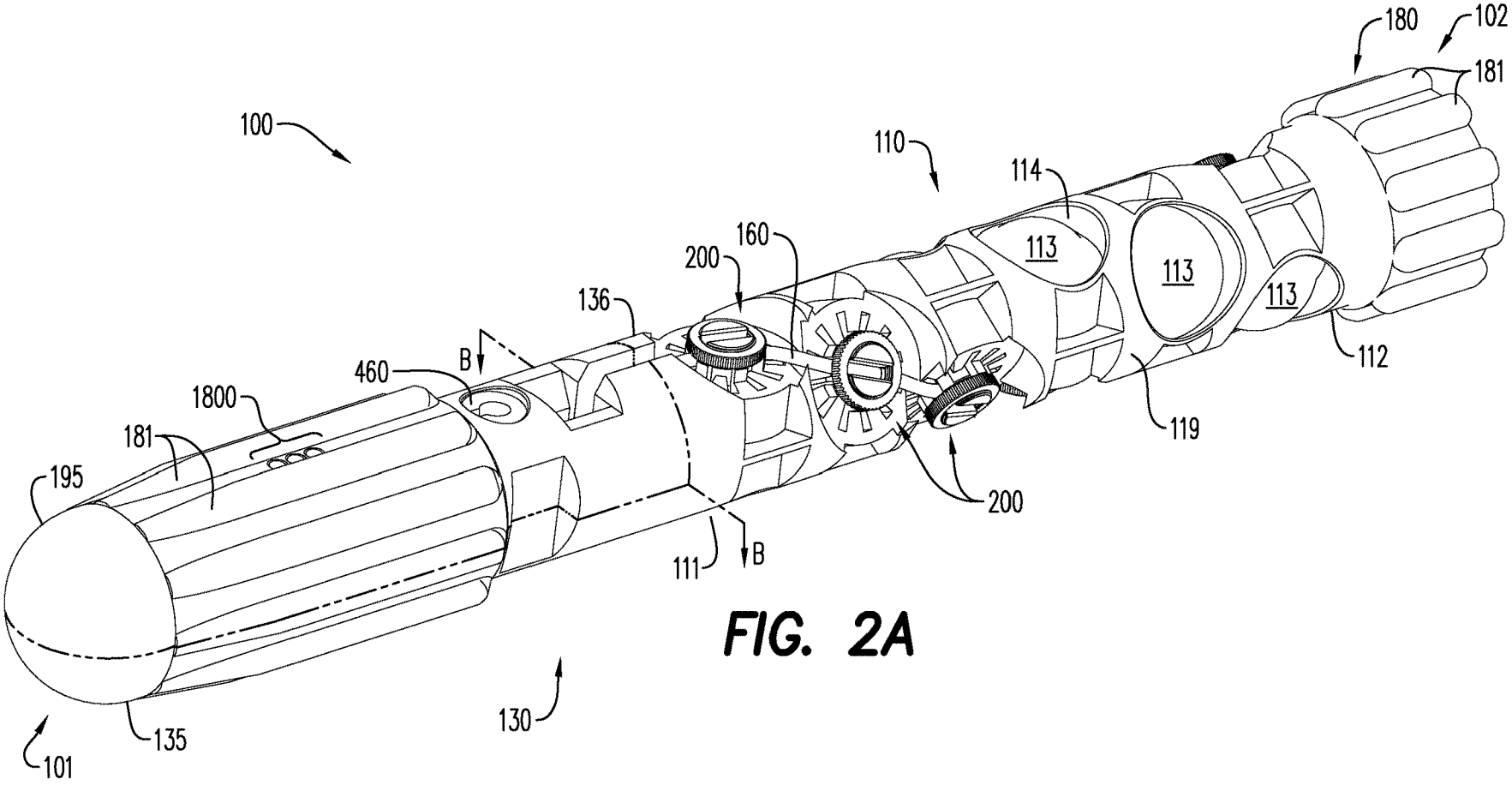
FIG. 2A is a side perspective view of a bottom-fire perforating drone according to an exemplary embodiment.
Figure 2B:
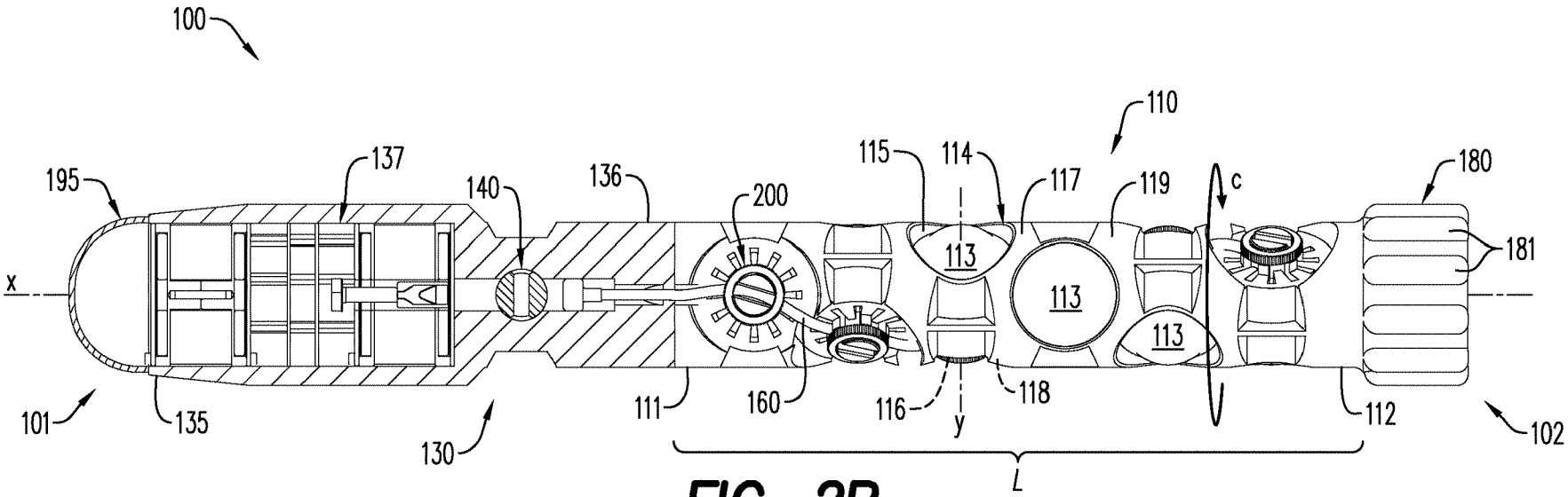
FIG. 2B is a side view with partial cross-sectional view taken along the planes by view 'B' of the bottom-fire perforating drone according to FIG. 2A.

Turning now to FIG. 2A and FIG. 2B, an exemplary embodiment of a bottom-fire perforating drone 100 according to this disclosure is shown. The exemplary bottom-fire perforating drone 100 is a generally (though not literally or limitingly) torpedo-shaped assembly or module with a circumferential aspect c formed about a longitudinal axis x. The bottom-fire perforating drone 100 includes a tip section 195 at a front (downstream) end 101 of the bottom-fire perforating drone 100 and a tail section 180 at a rear (upstream) end 102, opposite the front end 101, of the bottom-fire perforating drone 100. A perforating assembly section 110 and a control module section 130 are respectively positioned between the tail section 180 and the tip section 195. The control module section 130 is connected at a first end 135 of the control module section 130 to the tip section 195 and at a second end 136, opposite the first end 135, of the control module section 130 to a downstream end 111 of the perforating assembly section 110. The perforating assembly section 110 includes an upstream end 112 opposite the downstream end 111 and in the exemplary embodiment shown in FIG. 2A and FIG. 2B the upstream end 112 of the perforating assembly section 110 is connected to the tail section 180.

The tail section 180 may include guiding fins 181 for providing radial stability as the bottom-fire perforating drone 100 is traveling through a wellbore fluid within a wellbore. In various embodiments, one or more of the tip section 195, the control module section 130, the perforating assembly section 110, and the tail section 180 may have features such as guiding fins, a curved topology, etc. for providing one or more of rotational speed, radial stability, and reduced friction to the bottom-fire perforating drone 100.

For purposes of this disclosure, each of the "tip section", "control module section", "perforating assembly section", and "tail section" is defined with respect and reference to, and to aid in the description of, the position and configuration of certain structures and componentry of the exemplary embodiments of a bottom-fire perforating drone as described throughout this disclosure. None of the terms "tip section", "control module section", "perforating assembly section", or "tail section" is limited to any particular assembly, configuration, or delineation points of, or along, a bottom-fire perforating drone according to this disclosure. For example, any or all of the "tip section", "control module section", "perforating assembly section", and "tail section" may be integrally formed by injection molding, casting, 3D printing, 3D milling from bar stock, etc. For purposes of this disclosure, "integral" or "integrally formed" respectively means a single piece or formed as a single piece.

Further, for purposes of this disclosure, the term "connected" generally means joined, such as by mechanical features, adhesives, welding, friction fit, or other known techniques for joining separate components, and may also mean "integrally formed" as that term is used in this disclosure, except where otherwise indicated.

Moreover, for purposes of this disclosure, "upstream" means in a direction towards the wellbore entrance or surface and "downstream" means in a direction deeper or further into the wellbore. For example, as the bottom-fire perforating drone 100 travels downstream, the tip section 195 is positioned first in the wellbore fluid, the tip section 195 being positioned downstream of the tail section 180. The bottom-fire perforating drone 100 is deployed and conveyed through the wellbore fluid via known techniques including, but not limited to, pump down conveyance.

With continuing reference to FIG. 2A and FIG. 2B, the exemplary perforating assembly section 110 is generally defined by a perforating assembly section body 119 that is configured for, among other things, retaining one or more shaped charges 113 and a detonating cord 160 for delivery downhole in a wellbore. The perforating assembly section 110 is generally cylindrically-shaped and is formed about the longitudinal axis x. In the exemplary embodiment shown in FIG. 2A and FIG. 2B, the perforating assembly section 110 includes a plurality of shaped charges 113, and each shaped charge 113 is positioned and retained, in part, in a first opening 115 of an aperture 114 that extends laterally through the perforating assembly section 110 along an axis y. The aperture extends between the first opening 115 on a first side 117 of the perforating assembly section 110 and a second opening 116 on a second side 118, opposite the first side 117, of the perforating assembly section 110. The first side 117 of the perforating assembly section 110 and the second side 118 of the perforating assembly section 110 are defined separately for each of the plurality of apertures 114, according to the respective opposing portions of the perforating assembly section 110 through which a particular aperture 114 passes. As described in detail with respect to FIGS. 3A, 3B, 5A, and 5C-5E, a fixation assembly 200 of the exemplary embodiment shown in FIG. 2A and FIG. 2B is positioned about the second opening 116 of each aperture 114 and secures the shaped charge 113 within the aperture 114. The fixation assembly 200 may also secure the detonating cord 160 in place at each shaped charge 113 along a length L of the perforating assembly section 110, as described in detail with respect to FIGS. 5A-5E.

With reference specifically to FIG. 2A, the exemplary bottom-fire perforating drone 100 also includes, among other things, features such as charging/programming contacts 1800 for charging a power source and/or programming onboard circuitry contained in a control module 137 (FIG. 2B) of the bottom-fire perforating drone 100 and a ballistic interrupt actuator 460 for moving a ballistic interrupt 140 (FIG. 2B) between a closed state 143 (FIG. 3A) and an open state 144 (FIG. 3B) within the bottom-fire perforating drone 100. Aspect of these features are variously shown and described throughout this disclosure and in the figures, as follows.

Figure 3A:
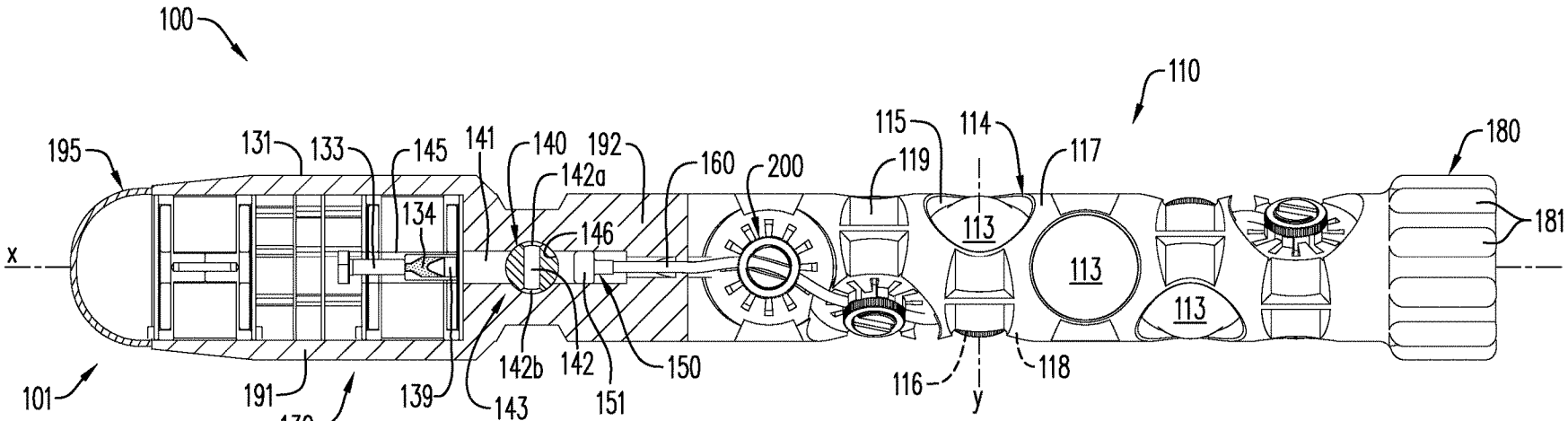
FIG. 3A is a side view with cross-sectional view of the exemplary embodiment according to FIG. 2B, with a ballistic interrupt in a closed state.
Figure 3B:
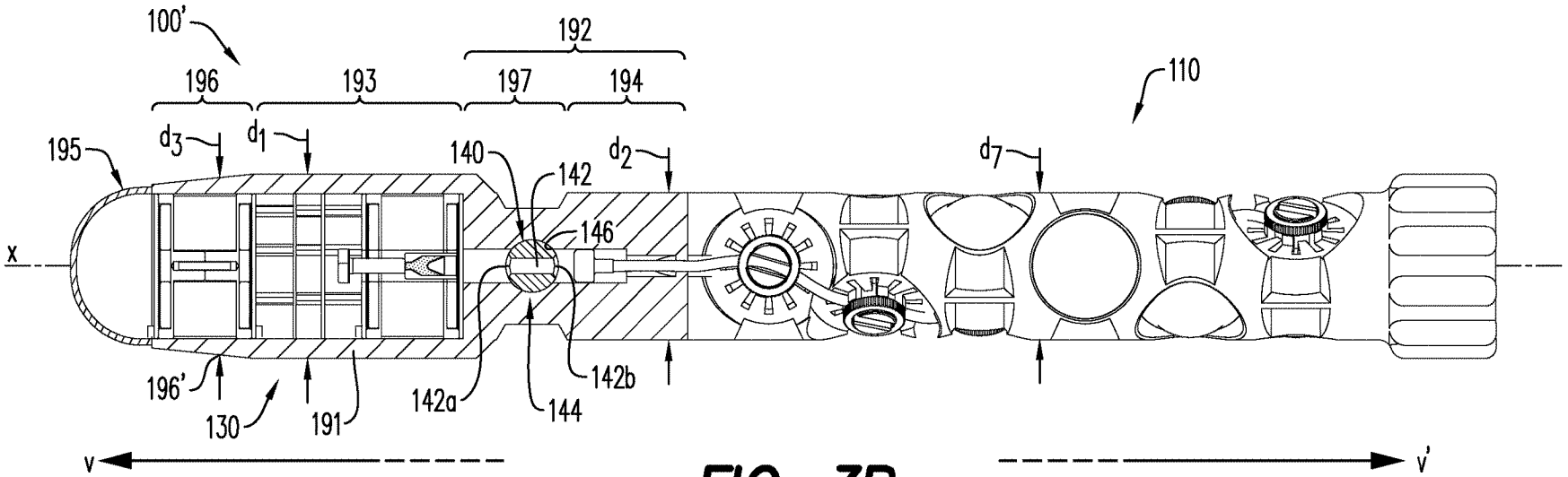
FIG. 3B is a side view with cross-sectional view of the exemplary embodiment according to FIG. 2B, with a ballistic interrupt in an open state.

With reference now to FIGS. 3A and 3B, each of those figures shows, among other things, a cross-section of the exemplary control module section 130 of the bottom-fire perforating drone 100 as generally described with respect to FIG. 2A and FIG. 2B. However, as explained in greater detail further below, FIG. 3A shows the exemplary bottom-fire perforating drone 100 with the ballistic interrupt 140 in a closed state 143 and FIG. 3B shows the exemplary bottom-fire perforating drone 100' with the ballistic interrupt in an open state 144.

Figure 4:
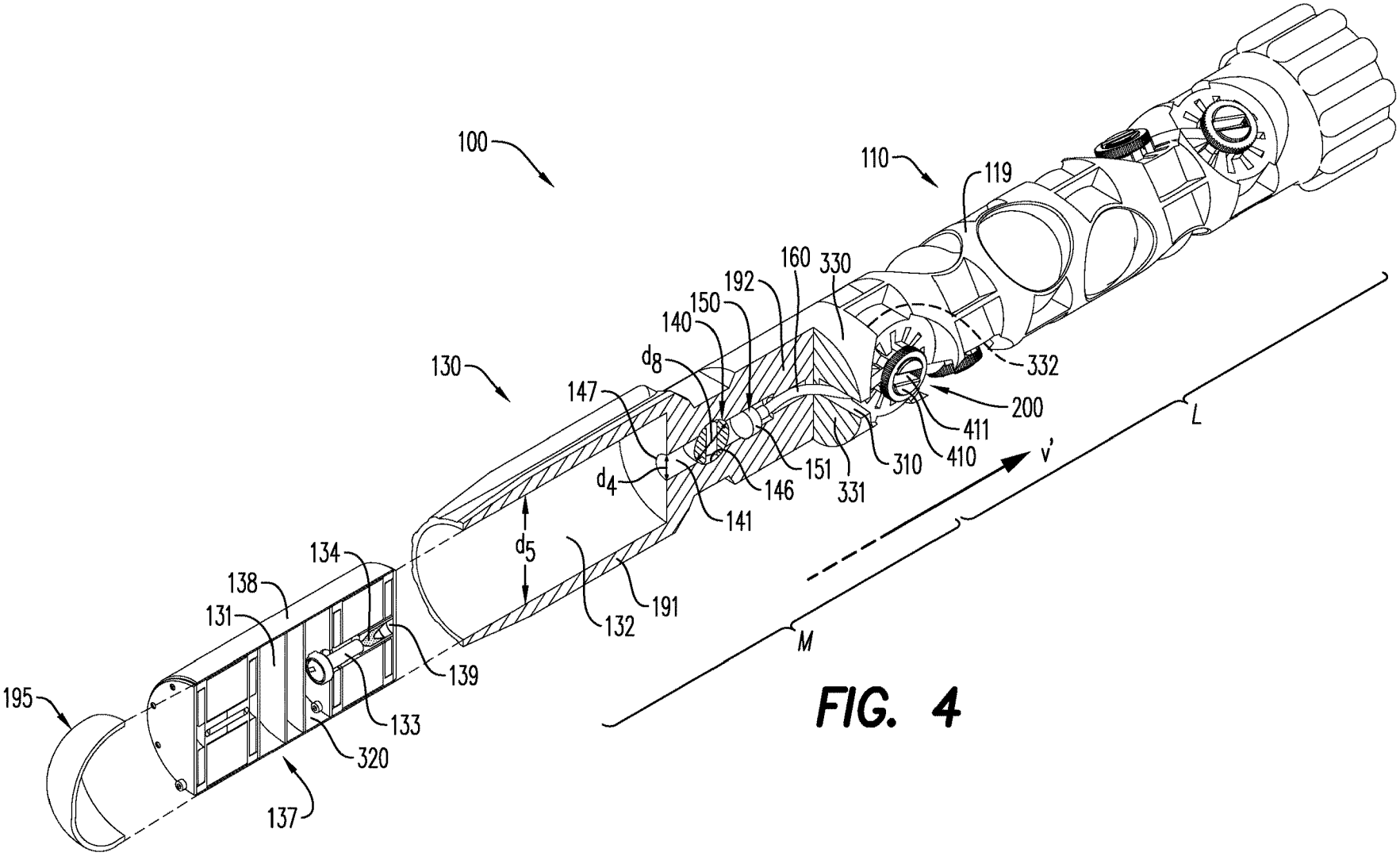
FIG. 4 is a perspective view with an exploded, cross-sectional view of a control module section of the exemplary embodiment according to FIG. 2B.

With continuing reference to FIGS. 2A-3B, and further reference to FIG. 4, the exemplary control module section 130 is generally defined by a control module section body 191 and is circumferentially-shaped and formed about the longitudinal axis x. The control module section 130 defined by the control module section body 191 has a profile including, among other things, a large diameter portion 193 with a diameter $d_1$, a reduced diameter portion 194 with a diameter $d_2$, a transition region 197 positioned between the large diameter portion 193 and the reduced diameter portion 194, and a tapered portion 196 with a diameter $d_3$ at a position 196' representing any particular point along the varying-diameter tapered portion 196 at which the diameter $d_3$ is measured. The diameter $d_1$ of the large diameter portion 193 is greater than the diameter $d_2$ of the reduced diameter portion 194. In the exemplary embodiments shown in FIGS. 3A and 3B, the diameter $d_2$ of the reduced diameter portion 194 is substantially equal to a diameter $d_7$ of the perforating assembly section 110.

The transition region 197 is connected to each of the large diameter portion 193 and the reduced diameter portion 194 and spans a space therebetween. The presence and profile of the transition region 197 is not limited by the disclosed embodiments and may take any shape or configuration as particular applications dictate. The tapered portion 196 is positioned and spans a gap between the large-diameter portion 194 of the control module section 130 and the tip section 195, and the diameter $d_3$ at the position 196' on the tapered portion 196 gradually decreases in a direction v from the large-diameter portion 194 of the control module section 130 towards the tip section 195. The exemplary profile of the control module section 130 shown in, e.g., FIG. 3B helps to reduce impacts and friction on the shaped charges 113 as the bottom-fire perforating drone 100, 100' travels through a wellbore fluid, whereby the large diameter portion 193 absorbs impacts against a wellbore casing and pushes wellbore fluid out and around the perforating assembly section 110. In other embodiments, the tip section 195 may have a different profile, for example and without limitation, an arrow-like or pointed tip.

For purposes of this disclosure, each of the "large diameter portion 193", "reduced diameter portion 194", "transition region 197", and "tapered portion 196" is defined with respect and reference to, and to aid in the description of, the profile of the exemplary control module section 130 shown in, e.g., FIGS. 3A and 3B. None of the terms "large diameter portion 193", "reduced diameter portion 194", "transition region 197", or "tapered portion 196" is limited to any particular assembly, configuration, or delineation points of, or along, a bottom-fire perforating drone according to this disclosure, nor is a control module section according to this disclosure limited to a profile including one or more diameters. For example and without limitation, the control module section 130 may be cylindrically shaped with a constant diameter, or may have a non-circumferential profile.

With continuing reference specifically to FIGS. 3A and 4 (and further shown and described with respect to FIG. 13B), the control module section 130 defined by the control module section body 191 includes, among other things, a hollow interior portion 132 and a ballistic channel 141 respectively positioned within the control module section 130 defined by the control module section body 191. The ballistic channel 141 is open to the hollow interior portion 132 and extends from the hollow interior portion 132 in a direction v' from the hollow interior portion 132 towards the perforating assembly section 110/tail section 180. In the exemplary embodiments shown in FIGS. 3A-4, the ballistic channel 141 is surrounded by a portion 192 of increased thickness of the control module section body 191 and has a diameter $d_4$ that is smaller than a diameter $d_5$ of the hollow interior portion 132. The diameter $d_4$ of the ballistic channel 141 is sized to receive a receiver booster 150 which, as shown in FIGS. 3A-4, is positioned within the ballistic channel 141, and the ballistic interrupt 140 is positioned within the ballistic channel 141 in a ballistic interrupt cavity 146 that is formed as an area of the ballistic channel 141 with a diameter $d_8$ which is larger than the diameter $d_4$ of the ballistic channel 141. The ballistic interrupt 140 and the receiver booster 150 are positioned in a spaced apart relationship within the ballistic channel 141 such that the ballistic interrupt 140 is nearer the hollow interior portion 132 and the receiver booster 150 is nearer the perforating assembly section 110. The receiver booster 150 is connected to the detonating cord 160, for example by crimping, within the ballistic channel 141, and the exemplary ballistic channel 141 shown in, e.g., FIGS. 3A-4, is sized to receive at least a portion of the detonating cord 160. The detonating cord 160 extends away from the receiver booster 150 in the direction v' towards the perforating assembly section 110/tail section 180, and opposite the direction v towards the ballistic interrupt 140.

In some embodiments, a set of stackable pellets may be used in conjunction with, or in place of, the receiver booster 150 for initiating the detonating cord 160 by ballistic force.

The control module section 130 and the hollow interior portion 132 are sized to receive the control module 137 which is positioned within the hollow interior portion 132 of the control module section 130. The control module 137 includes a housing 138 that defines an inner area 320 of the control module 137 and encloses, for example and without limitation, a detonator 133, a donor charge 134, and a control assembly 131. The control module 137 and the control assembly 131 are further shown and described with respect to FIG. 12. With continuing reference to FIGS. 3A-4, the control assembly 131 may include controlling and operational components of the bottom-fire perforating drone 100, such as, without limitation, a power source/battery, sensors, depth correlation device, programmable electronic circuit, trigger circuit, detonator fuse, etc. A power source/battery may also be positioned within the hollow interior portion 132, itself, as may other components that do not necessarily need the isolation or component assemblies within the inner area 320 of the control module 137. These and other components are discussed in additional detail with respect to the operation of the bottom-fire perforating drone 100.

The modular, i.e., self-contained, nature of the control module 137 allows it to be removed/removable from the bottom-fire perforating drone 100 during transport, e.g., to comply with regulatory requirements, and quickly loaded into the bottom-fire perforating drone 100 at a wellsite. The inner area 320 of the control module 137 can be completely or partially hollow, or not hollow at all, depending on the layout of the control module components and the requirements for sealing the control module 137. For example, in an exemplary embodiment the control module 137 is pressure sealed to protect the components within the control module 137 from environmental conditions both outside of and within the wellbore. In other embodiments one or more of the control module 137, control module section 130, and hollow interior portion 132 may include various known seals to protect the control module 137 and the components within the control module 137, components within the hollow interior portion 132, or other components within the control module section 130 generally.

According to a further aspect, an electrical selective sequence signal may be sent from, e.g., the programmable electronic circuit to the detonator 133 to initiate the detonator when the bottom-fire perforating drone 100 reaches at least one of a threshold pressure, temperature, horizontal orientation, inclination angle, depth, distance traveled, rotational speed, and position within the wellbore. The threshold conditions may be measured by any known devices consistent with this disclosure including a temperature sensor, a pressure sensor, a positioning device as a gyroscope and/or accelerometer (for horizontal orientation, inclination angle, and rotational speed), and a correlation device such as a casing collar locator (CCL) or position determining system (for depth, distance traveled, and position within the wellbore) as discussed below with respect to FIGS. 6A-9 and FIG. 12. The electrical selective sequence signal may include one or more of an addressing signal for activating one or more power components of the detonator 133, an arming signal for activating a detonator firing assembly such as a trigger circuit or capacitor, and a detonating signal for detonating the detonator 133. The threshold values and other instructions for addressing, arming, and/or detonating the detonator 133 may be taught to the programmable electronic circuit by, for example and without limitation, a control unit at a factory or assembly location or at the surface of the wellbore prior to deploying the bottom-fire perforating drone 100 into the wellbore. In an aspect, the selective sequence signal may be one or more digital codes including or more digital codes uniquely configured for the detonator 133 of each particular bottom-fire perforating drone 100.

Figure 6B:
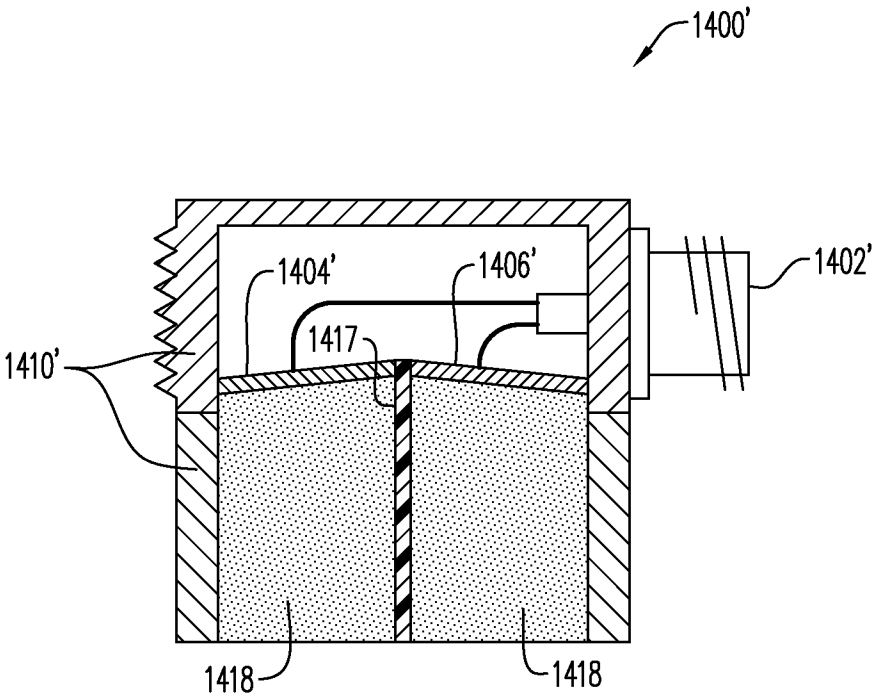
FIG. 6B is a cross-sectional, side plan view of an ultrasonic transceiver utilized in an embodiment.
Figure 6A:
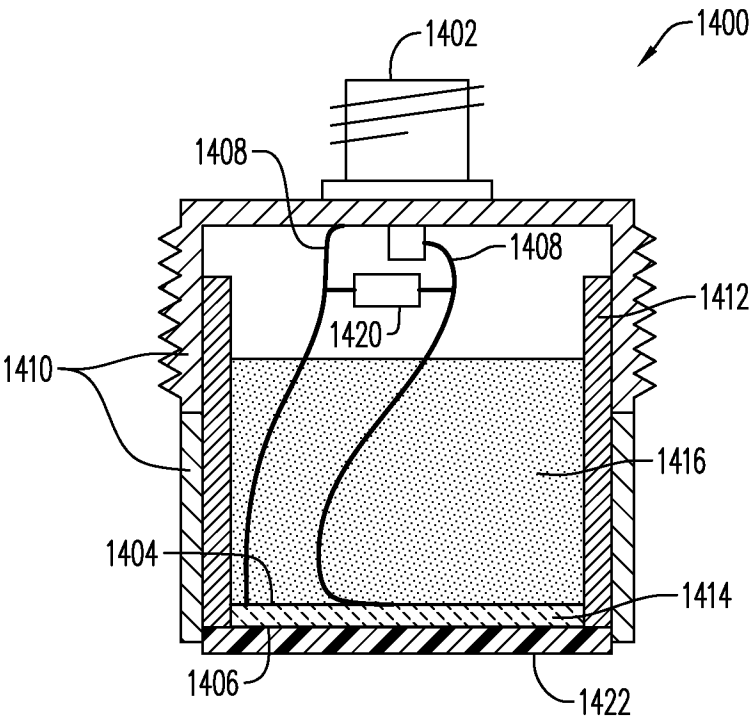
FIG. 6A is a cross-sectional, side plan view of an ultrasonic transceiver utilized in an embodiment.

FIG. 6A is a cross-section of an ultrasonic transducer 1400 that may be used in a system and method of determining location along a wellbore 2016. The transducer 1400 may include a housing 1410 and a connector 1402; the connector 1402 is the portion of the housing 1410 allowing for connections to, e.g., the programmable electronic circuit that may generate and interpret the ultrasound signals. The key elements of the transducer 1400 are a transmitting element 1404 and a receiving element 1406 that are contained in the housing 1410. In the transducer shown in FIG. 6A, the transmitting element 1404 and the receiving element 1406 are integrated into a single active element 1414. That is, the active element 1414 is configured to both transmit an ultrasound signal and receive an ultrasound signal. Electrical leads 1408 are connected to electrodes on the active element 1414 and convey electrical signals to/from the programmable electronic circuit. An electrical network 1420 may be connected between the electrical leads 1408. Optional elements of a transducer include a sleeve 1412, a backing 1416 and a cover/wearplate 1422 protecting the active element 1414.

FIG. 6B is a cross-section of an alternative version of an ultrasonic transducer 1400' that may be used in a system and method of determining location along a wellbore 2016. The transducer 1400' may include a housing 1410' and a connector 1402'; the connector 1402' is the portion of the housing 1410' allowing for connections to, e.g., the programmable electronic circuit that may generate and interpret the ultrasound signals. The key elements of the transducer 1400' are a transmitting element 1404' and a receiving element 1406' that are contained in the housing 1410'. A delay material 1418 and an acoustic barrier 1417 are provided for improving sound transmission and receipt in the context of a separate transmitting element 1404' and receiving element 1406' apparatus.

Figure 7:
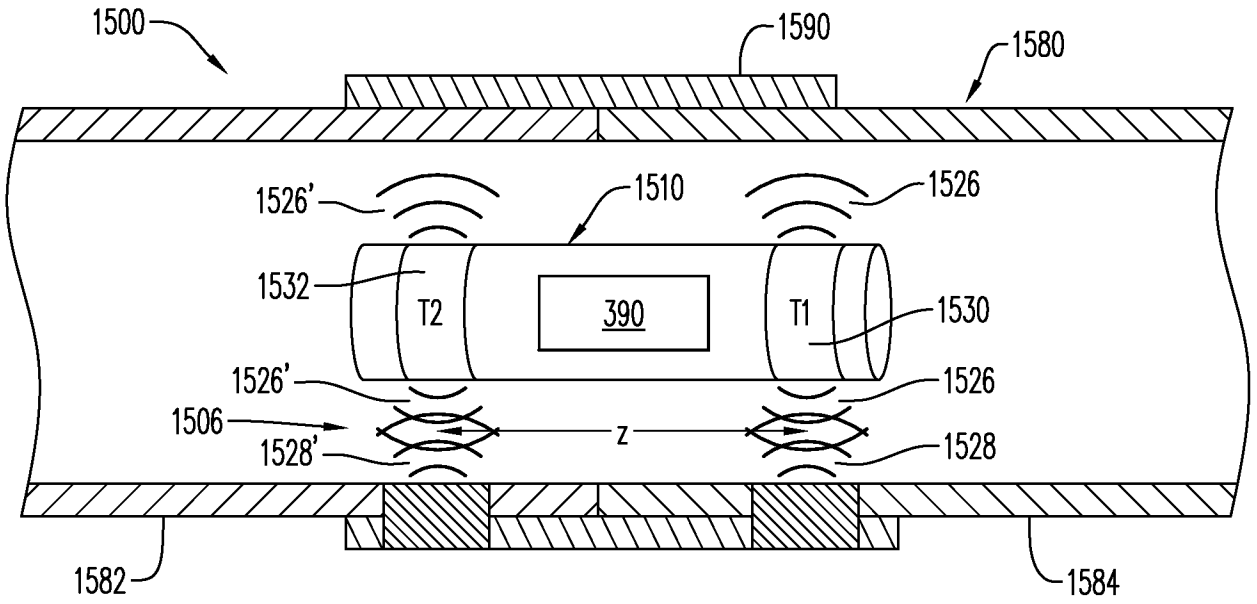
FIG. 7 is a cross-sectional plan view of a two ultrasonic transceiver based navigation system of an embodiment.

With additional reference to FIG. 7, an exemplary bottom-fire perforating drone 1510 as part of an ultrasonic transducer system 1500 for determining the speed of the bottom-fire perforating drone 1510 traveling down a wellbore 2016 by identifying ultrasonic waveform changes is shown. As depicted in FIG. 7, the bottom-fire perforating drone 1510 may be equipped with one or more ultrasonic transducers 1530, 1532. In an embodiment, the bottom-fire perforating drone 1510 has a first transducer 1530 (also marked T1) and a second transducer 1532 (also marked T2), one at each end of the bottom-fire perforating drone 1510. The distance separating the first transducer 1530 from the second transducer 1532 is a constant and may be referred to as distance 'Z'. Each of the first transducer 1530 and the second transducer 1532 may have a transmitting element 1404 and a receiving element 1406 (as shown in FIGS. 6A and 6B) that sends/receives signals radially from the bottom-fire perforating drone 1510. In an embodiment, each transmitting element 1404 and receiving element 1406 may be disposed about an entire radius of the bottom-fire perforating drone 1510; such an arrangement permits the transmitting element 1404 and the receiving element 1406 respectively to send and receive signals about essentially the entire radius of the bottom-fire perforating drone 1510.

The exemplary bottom-fire perforating drone 1510 shown in FIG. 7 includes the first ultrasonic transceiver 1530 and the second ultrasonic transceiver 1532. Each of the first ultrasonic transceiver 1530 and the second ultrasonic transceiver 1532 is capable of detecting alterations in the medium through which the bottom-fire perforating drone 1510 is traversing by transmitting an ultrasound signal 1526, 1526' and receiving a return ultrasound signal 1528, 1528'. Changes in the material and geometry of the wellbore casing 1580 and other material external to wellbore casing 1580 will often result in a substantial change in the return ultrasound signal 1528, 1528' received by receiving element 1406 and conveyed to bottom-fire perforating drone 1510, e.g., by the programmable electronic circuit.

With continuing reference to FIG. 7, because T2 1532 is axially displaced from T1 1530 along the long axis of the bottom-fire perforating drone 1510, T2 1532 passes through an anomaly in the wellbore 2016 at a different time than T1 1530 as the bottom-fire perforating drone 1510 traverses the wellbore 2016. Put another way, assuming the existence of an anomalous point 1506 along the wellbore, T1 1530 and T2 1532 pass the anomalous point 1506 in wellbore 1070 at slightly different times. In the event that T1 1530 and T2 1532 both register a sufficiently strong and identical, i.e., repeatable, modified return signal as a result of an anomaly at the anomalous point 1506, it is possible to determine the time difference between T1 1530 registering the anomaly at the anomalous point 1506 and T2 1532 registering the same anomaly. The distance Z between T1 1530 and T2 1532 being known, a sufficiently precise measurement of time between T1 1530 and T2 1532 passing a particular anomaly provides a measure of the velocity of the bottom-fire perforating drone 1510, i.e., velocity equals change in position divided by change in time. Utilizing the typically safe presumption that an anomaly is stationary, the velocity of the bottom-fire perforating drone 1510 through the wellbore 2016 is available every time the bottom-fire perforating drone 1510 passes an anomaly that returns a sufficient change in amplitude of a return signal for each of T1 1530 and T2 1532.

The potential exists for locating ultrasonic transceiver T1 1530 and ultrasonic transceiver T2 1532 in different portions of the bottom-fire perforating drone 1510 and connecting them electrically to the programmable electronic circuit. As such, it is possible to increase the axial distance Z between T1 1530 and T2 1532 almost to the limit of the total length of the bottom-fire perforating drone 1510. Placing T1 1530 and T2 1532 further away from one another achieves a more precise measure of velocity and retains precision more effectively as higher drone velocities are encountered, especially where sample rates for T1 1530 and T2 1532 reach an upper limit.

Figure 8:
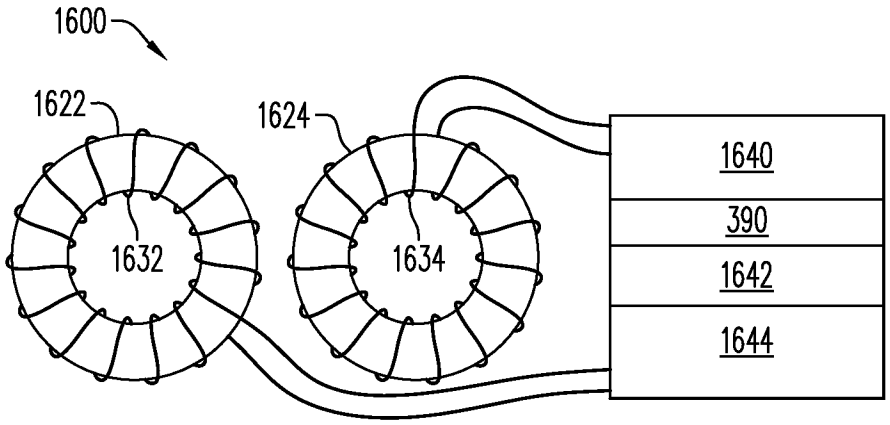
FIG. 8 is a plan view of a navigation system of an embodiment.

In an exemplary embodiment of a navigation system 1600 such as used in the ultrasonic transducer system 1500 shown in FIG. 7, two wire coils 1632, 1634 are respectively used with the transceivers 1530, 1532. As seen in FIG. 8, a signal generating and processing unit 1640 is attached to both ends of a first coil 1632 wrapped around a first core 1622 of high magnetic permeability material and a second coil 1634 wrapped around a second core 1624 of high magnetic permeability material. As discussed previously, although the cores 1622, 1624 and the coils 1632, 1634 are presented in FIG. 8 as toroidal in shape, other shapes are possible. The first coil 1632 and the second coil 1634 of the exemplary embodiment shown in FIG. 7 and FIG. 8 are configured coplanar to one another. Since a toroidal coil defines a plane, the magnetic field established by such a coil possesses a structure related to this plane. Changes in magnetic permeability occurring coplanar to the plane of the toroidal coil will have greater effect on the coil's inductance than changes that are not coplanar. Changes in magnetic permeability in a plane perpendicular to the plane of the coil may have little to no impact on the coil's inductance value. As previously described, the exemplary ultrasonic transducer system 1500 may register the same anomaly, i.e., change in magnetic permeability, once for each coil 1632, 1634. In this configuration, having the coils 1632, 1634 disposed on the same plane may achieve this result.

The processing unit 1640 may include an oscillator circuit 1644 and a capacitor 1642. An oscillating signal is generated by the oscillator circuit 1644, and sent to the wire coils 1632, 1634. With the wire coils 1632, 1634 acting as inductors, a magnetic field is established around the wire coils 1632, 1634 when charge flows through the wire coils 1632, 1634. Insertion of the capacitor 1642 in the processing unit 1640 results in constant transfer of electrons between the wire coils/inductors 1632, 1634 and the capacitor 1642, i.e., in a sinusoidal flow of electricity between the wire coils 1632, 1634 and the capacitor 1642. The frequency of this sinusoidal flow will depend upon the capacitance value of the capacitor 1642 and the magnetic field generated around the wire coils 1632, 1634, i.e., the inductance value of the wire coils 1632, 1634. The peak strength of the sinusoidal magnetic field around the wire coils 1632, 1634 will depend on the materials immediately external to the wire coils 1632, 1634. With the capacitance of the capacitor 1642 being constant and the peak strength of the magnetic field around the wire coils 1632, 1634 being constant, the circuit will resonate at a particular frequency. That is, current in the circuit will flow in a sinusoidal manner having a frequency, referred to as a resonant frequency, and a constant peak current.

Figure 9:
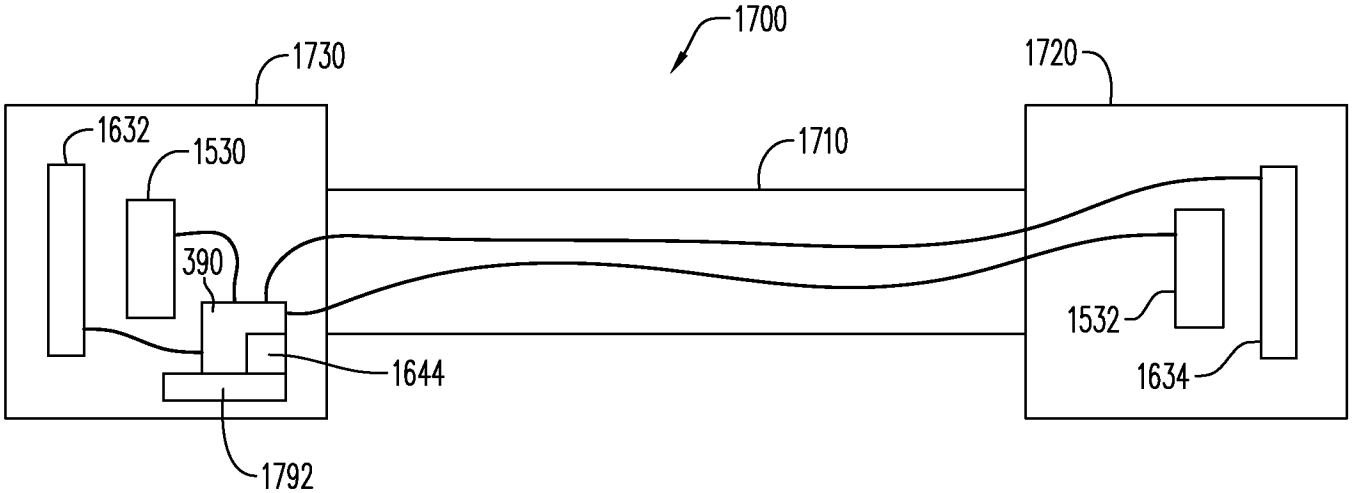
FIG. 9 is a block diagram, cross sectional view of a drone in accordance with an embodiment.

With reference to FIG. 9, a schematic cross-sectional view of a bottom-fire perforating drone 1700 as generally described throughout this disclosure is shown. For example, the bottom-fire perforating drone 1700 may take the form of the bottom-fire perforating drone 100 shown in FIGS. 2A-3B. For example, the body portion 1710 of the bottom-fire perforating drone 1700 may bear one or more shaped charges. As is well-known in the art, detonation of the shaped charges is typically initiated with an electrical pulse or signal supplied to a detonator. The detonator of the bottom-fire perforating drone embodiment 1700 shown in FIG. 9 and generally with respect to the exemplary embodiments of a bottom-fire perforating drone as described throughout this disclosure—e.g., in FIGS. 2A-3B—may be located in the control module section 130, the perforating assembly section 110, or at a position or intersection therebetween. The detonator 133 may initiate the shaped charges either directly or through an intermediary structure such as a detonating cord.

As would be understood by one of ordinary skill in the art, electrical power typically supplied via the wireline cable 2012 to wellbore tools, such as a tethered drone or typical perforating gun, would not be available to a bottom-fire perforating drone as described herein and shown in FIG. 9. In order for all components of the bottom-fire perforating drone 1700 to be supplied with electrical power, a power supply 1792 may be included generally as part of the bottom-fire perforating drone 1700 in any portion such as configurations dictate. It is contemplated that the power supply 1792 may be disposed so that it is adjacent any components of the bottom-fire perforating drone 1700 that require electrical power (such as an onboard computer 390).

The on-board power supply 1792 for the bottom-fire perforating drone 1700 may take the form of an electrical battery; the battery may be a primary battery or a rechargeable battery. Whether the power supply 1792 is a primary or rechargeable battery, it may be inserted into the bottom-fire perforating drone 1700 at any point during construction of the bottom-fire perforating drone 1700 or immediately prior to insertion of the bottom-fire perforating drone 1700 into the wellbore 2016. If a rechargeable battery is used, it may be beneficial to charge the battery immediately prior to insertion of the bottom-fire perforating drone 1700 into the wellbore 2016. Charge times for rechargeable batteries are typically on the order of minutes to hours.

In an embodiment, another option for the power supply 1792 is the use of a capacitor or a supercapacitor. A capacitor is an electrical component that consists of a pair of conductors separated by a dielectric. When an electric potential is placed across the plates of a capacitor, electrical current enters the capacitor, the dielectric stops the flow from passing from one plate to the other plate and a charge builds up. The charge of a capacitor is stored as an electric field between the plates. Each capacitor is designed to have a particular capacitance (energy storage). In the event that the capacitance of a chosen capacitor is insufficient, a plurality of capacitors may be used. When a capacitor is connected to a circuit, a current will flow through the circuit in the same way as a battery. That is, when electrically connected to elements that draw a current the electrical charge stored in the capacitor will flow through the elements. Utilizing a DC/DC converter or similar converter, the voltage output by the capacitor will be converted to an applicable operating voltage for the circuit. Charge times for capacitors are on the order of minutes, seconds or even less.

A supercapacitor operates in a similar manner to a capacitor except there is no dielectric between the plates. Instead, there is an electrolyte and a thin insulator such as cardboard or paper between the plates. When a current is introduced to the supercapacitor, ions build up on either side of the insulator to generate a double layer of charge. Although the structure of supercapacitors allows only low voltages to be stored, this limitation is often more than outweighed by the very high capacitance of supercapacitors compared to standard capacitors. That is, supercapacitors are a very attractive option for low voltage/high capacitance applications as will be discussed in greater detail hereinbelow. Charge times for supercapacitors are only slightly greater than for capacitors, i.e., minutes or less.

A battery typically charges and discharges more slowly than a capacitor due to latency associated with the chemical reaction to transfer the chemical energy into electrical energy in a battery. A capacitor is storing electrical energy on the plates so the charging and discharging rate for capacitors are dictated primarily by the conduction capabilities of the capacitors plates. Since conduction rates are typically orders of magnitude faster than chemical reaction rates, charging and discharging a capacitor is significantly faster than charging and discharging a battery. Thus, batteries provide higher energy density for storage while capacitors have more rapid charge and discharge capabilities, i.e., higher power density, and capacitors and supercapacitors may be an alternative to batteries especially in applications where rapid charge/discharge capabilities are desired.

Thus, the on-board power supply 1792 for the bottom-fire perforating drone 1700 may take the form of a capacitor or a supercapacitor, particularly for rapid charge and discharge capabilities. A capacitor may also be used to provide additional flexibility regarding when the power supply is inserted into the bottom-fire perforating drone 1700, particularly because the capacitor will not provide power until it is charged. Thus, shipping and handling of the bottom-fire perforating drone 1700 containing shaped charges or other explosive materials presents low risks where an uncharged capacitor is installed as the power supply 1792. This is contrasted with shipping and handling of a bottom-fire perforating drone 1700 with a battery, which can be an inherently high risk activity and frequently requires a separate safety mechanism to prevent accidental detonation. Further, and as discussed previously, the act of charging a capacitor is very fast. Thus, the capacitor or supercapacitor being used as a power supply 1792 for the bottom-fire perforating drone 1700 can be charged immediately prior to deployment of the bottom-fire perforating drone 1700 into the wellbore 2016.

In an aspect, magnetic sensors such as Hall effect magnetic sensors or magnetometers may be used in combination with a super capacitor as a depth correlation sensor in the exemplary bottom-fire perforating drones described herein. Such a system may be used with a magnetic ring (e.g., a plastic with flexible magnetic tape or film secured thereto) between adjacent wellbore casings, for example, at a collar between casing ends, wherein the magnetic ring includes beacons or magnets for detection by the drone sensors. In another aspect, casing collars may be painted with high temperature paint or adhesives including magnetic material such as metal fillings, powder, or flakes.

While the option exists to ship the bottom-fire perforating drone 1700 preloaded with a rechargeable battery which has not been charged, i.e., the electrochemical potential of the rechargeable battery is zero, this option comes with some significant drawbacks. The goal must be kept in mind of assuring that no electrical charge is capable of inadvertently accessing any and all explosive materials in the bottom-fire perforating drone 1700. Electrochemical potential is often not a simple, convenient or failsafe thing to measure in a battery. It may be the case that the potential that a 'charged' battery may be mistaken for an 'uncharged' battery simply cannot be reduced sufficiently to allow for shipping the bottom-fire perforating drone 1700 with an uncharged battery. In addition, as mentioned previously, the time for charging a rechargeable battery having adequate power for the bottom-fire perforating drone 1700 could be on the order of an hour or more. Currently, fast recharging batteries of sufficient charge capacity are uneconomical for the 'one-time-use' or 'several-time-use' that would be typical for batteries used in the bottom-fire perforating drone 1700.

In an embodiment, electrical components of an exemplary bottom-fire perforating drone as described throughout this disclosure including the control module 137, an oscillator circuit 1644, one or more wire coils 1632, 1634, and one or more ultrasonic transceivers 1530, 1532 may be battery powered while explosive elements like the detonator for initiating detonation of the shaped charges are capacitor powered. Such an arrangement would take advantage of the possibility that some or all of the control module 137, the oscillator circuit 1644, the wire coils 1632, 1634, and the ultrasonic transceivers 1530, 1532 may benefit from a high density power supply having higher energy density, i.e., a battery, while initiating elements such as detonators typically benefit from a higher power density, i.e., capacitor/supercapacitor. A very important benefit for such an arrangement is that the battery is completely separate from the explosive materials, affording the potential to ship the bottom-fire perforating drone 1700 preloaded with a charged or uncharged battery. The power supply that is connected to the explosive materials, i.e., the capacitor/supercapacitor, may be very quickly charged immediately prior to dropping the bottom-fire perforating drone 1700 into wellbore 2016.

In an aspect, a capacitor used as a power supply in the exemplary bottom-fire drones described throughout this disclosure may be charged to 30-40 Amps, and/or charged for approximately 15-40 minutes per bottom-fire perforating drone, and provide approximately 1 hour of active power.

As shown in the exemplary embodiment of FIG. 3A, when the control module 137 is received within the hollow interior portion 132 of the control module section 130, the donor charge 134 is adjacent to and substantially aligned with the ballistic channel 141, and a portion 139 of the control module housing 138 is positioned between the donor charge 134 and the ballistic channel 141. For purposes of this disclosure, "adjacent" means next to or near, but is not limited to directly abutting and does not exclude the presence of intervening structures. Thus, when the control module 137 is received within the hollow interior portion 132 of the control module section 130, the ballistic interrupt 140 within the ballistic channel 141 is positioned in a spaced apart relationship between the donor charge 134 and the receiver booster 150.

In an aspect, the donor charge 134 is positioned within a detonator channel 145 within the control module 137, and the detonator 133 is positioned adjacent to the donor charge 134 within the detonator channel 145 and substantially aligned with the donor charge 134 along the longitudinal axis x. The detonator 133 may be, for example and without limitation, an explosive charge or any other device as is well known in the art for causing a detonation, ignition, or ballistic initiation. In an aspect, the detonator 133 may be a selective detonator. For purposes of this disclosure, "selective" means that the detonator 133 is initiated only when it receives a specific initiating signal or selective sequence signal, as discussed above, from the control module 137 (i.e., the programmable electronic circuit), e.g., to cause a capacitive discharge to a fuse of the detonator 133. One benefit of a selective detonator is that it is radio-frequency (RF)-safe—i.e., it will not be initiated by stray RF signals in the proximity of the detonator 133.

The donor charge 134 is also an explosive shaped charge, but the donor charge 134 may include, for example, an explosive material within a casing (not numbered), designed to create a directed perforating jet upon detonation, as is well known in the art. According to the exemplary configuration, detonating the detonator 133 will cause the donor charge 134 to detonate.

The ballistic interrupt 140 is thus an important safety and operational feature of the bottom-fire perforating drone 100. For example, in operation, when the donor charge 134 is detonated it produces the perforating jet that pierces the portion 139 of the control module housing 138 between the donor charge 134 and the ballistic channel 141, and travels into the ballistic channel 141. When the ballistic interrupt 140 is in the closed state 143 shown in FIG. 3A, it provides a physical barrier and thereby prevents the perforating jet created by the donor charge 134 from reaching the receiver booster 150 and thereby initiating detonation (as explained further below) of the bottom-fire perforating drone 100. Specifically, with continuing reference to the exemplary embodiment shown in FIGS. 3A and 4, the ballistic interrupt 140 includes a through-bore 142 that extends through the ballistic interrupt 140 between a first opening 142*a* of the through-bore 142 and a second opening 142*b* of the through-bore 142. When the ballistic interrupt 140 is in the closed state 143, the through-bore 142 is substantially perpendicular to the longitudinal axis x and the ballistic interrupt 140 otherwise prevents ballistic communication between the donor charge 134 and the receiver booster 150 by shielding the receiver booster 150 from the perforating jet created by the donor charge 134. Accordingly, the ballistic interrupt 140 in the closed state 143 does not provide a path through which the perforating jet created by the donor charge 134 may reach the receiver booster 150 and thus is no longer ballistically aligned with the donor charge 134. In a further aspect of the exemplary closed state 143, the first opening 142*a* and the second opening 142*b* of the through-bore 142 may be positioned within an area of the ballistic interrupt cavity 146 at the diameter $d_5$ which is beyond the diameter of the ballistic channel 141 and may enhance the shielding effect of the ballistic interrupt 140. In another aspect, the ballistic interrupt 140 may include additional holes therethrough and/or in communication with the through-bore 142, for preventing failure or collapse of the bottom-fire perforating drone 100 due to a pressure differential across the ballistic interrupt 140.

In some embodiments, the detonator 133 may be spaced apart from the donor charge 134. For example, a donor charge may be positioned in the ballistic channel 141 or in the through-bore 142 of the ballistic interrupt 140. In such embodiments, the detonator 133 would provide sufficient ballistic energy to reach the spaced-apart donor charge, which may include, e.g., penetrating the portion 139 of the control module housing 138 between the detonator channel 145 and the ballistic channel 141. In embodiments in which a donor charge is positioned in the through-bore 142, the ballistic energy of the detonator 133 would be insufficient to initiate the donor charge through the ballistic interrupt 140 in the closed state 143. Thus, the safety control provided by the ballistic interrupt 140 would not be compromised.

On the other hand, when the bottom-fire perforating drone 100 is ready for arming, e.g., after passing a safety check and a function test at a wellbore site and immediately before or while being deployed into the wellbore, the ballistic interrupt 140 is moved to the open state 144 as shown in FIG. 3B. In the open state 144, the through-bore 142 is substantially parallel to the longitudinal axis x and coaxial with the ballistic channel 141. The through-bore 142 in the open state 144 allows ballistic communication via the through-bore 142 between the donor charge 134 and the receiver booster 150 such that the perforating jet created by the donor charge 134 may reach the receiver booster 150, causing the receiver booster 150 to detonate when subject to the perforating jet. The receiver booster 150 is generally an explosive charge or any other device, as is well known in the art, for causing an explosion, initiation, or ballistic force, including encapsulated receiver boosters and receiver boosters in a pressure sealed housing 151. Detonation of the receiver booster 150 initiates the detonating cord 160 which is further connected to and configured for detonating the shaped charges 113, as is generally known and explained in additional detail with respect to FIG. 5A.

The pressure sealed housing 151 of the receiver booster 150 may further extend to, or a separate pressure sealed housing may be used for, the connection between the receiver booster 150 and the detonating cord 160. In an aspect, the pressure sealed housing 151 may be rated to at least 10,000 psi and, for exemplary uses, to at least between 15,000 psi and 20,000 psi to enhance waterproof capability. In another aspect, a small amount of grease may be used at a crimp connection between the receiver booster 150 and the detonating cord 160 to prevent water invasion into the connection. As fluid ingression could potentially desensitize the explosives in the detonating cord 160, other techniques for sealing the receiver booster 150 onto the detonating cord 160, and/or sealing the detonating cord 160, are contemplated and include, without limitation, housing the receiver booster 150 and/or the detonating cord 160 in a cap that may include a grommet (or the like) for passing or fitting the detonating cord 160 therethrough, and may further include additional sealing mechanisms such as internal O-rings (or the like) for preventing fluid from seeping into the explosives at certain junctions. In addition, internal contours of the bottom-fire perforating drone 100, e.g., the configuration of the ballistic channel 141, may be conformed closely to the contour(s) of the receiver booster 150 and the detonating cord 160, including any housings, caps, or sealing mechanisms thereon, to decrease the area through which fluid may encounter the components/connections.

In a further aspect, the receiver booster 150 may be enlarged relative to the detonating cord 160 to prevent an initial bend or curve in the detonating cord 160 which may interfere with assembly of the detonating cord 160 to the receiver booster 150 and result in nicks or crimps in the detonating cord 160. In still a further aspect, the detonating cord 160 may be energetically coupled to the receiver booster 150 by engaging a lower end of the receiver booster 150 or being placed in a side-by-side configuration with the receiver booster 150.

The ballistic interrupt 140 is movable between the closed state 143 and the open state 144 using, for example, a mechanical key as part of a control system at the surface of the wellbore. With reference to the exemplary embodiment shown in FIG. 5A, the ballistic interrupt 140 includes a ballistic interrupt actuator 460 that is part of or in operable connection with the ballistic interrupt 140, for example when the ballistic interrupt 140 is cylindrical and extends laterally through the bottom-fire perforating drone 100, and is received in an opening 462 in the control module section body 191. The ballistic interrupt actuator 460 includes a keyway 461 for receiving the mechanical key (not shown). The mechanical key may rotate the keyway 461 using a rotational force, thereby rotating the ballistic interrupt 140 between the closed state 143 and the open state 144 (or vice versa). In the exemplary embodiments, the ballistic interrupt 140 is substantially cylindrically-shaped or spherically shaped and is rotatable between the closed state 143 and the open state 144 (and vice versa). The ballistic interrupt 140 including the ballistic interrupt actuator 460 is further shown and described with respect to FIG. 12. In other embodiments, the ballistic interrupt 140 may take any shape or configuration consistent with this disclosure, i.e., movable between a closed state and an open state. The ballistic interrupt 140 may also be moved by other mechanical techniques and using other configurations of a ballistic interrupt actuator and mechanical engagement or otherwise, such as a socket-nut engagement or pin-slot engagement, or may be movable via a magnetic engagement, or via a tool that extends through the control module section body 191 and directly engages the ballistic interrupt 140.

FIG. 4 shows, among other things, an exploded, cross-sectional view of the control module section 130 of the exemplary bottom-fire perforating drone 100. For example, the control module 137 is shown removed from the hollow interior 132 of the control module section 130 and an opening 147 from the ballistic channel 141 into the hollow interior portion 132 is visible. It is through the opening 147 that a perforating jet created by the donor charge 134 travels into the ballistic channel 141 and, if the ballistic interrupt 140 is in the open state 144, through the through-bore 142, and ultimately arrives at the receiver booster 150 to initiate the detonating cord 160 that is attached to the receiver booster 150.

The detonating cord 160 extends away from the receiver booster 150 in the direction v' towards, e.g., the perforating assembly section 110 and the shaped charges 113 positioned therein. The detonating cord 160 may be any known detonating cord that is pressure and temperature resistant to downhole conditions. A conversion region 330 guides the detonating cord 160 to a connecting portion 410 (FIGS. 5A, 5B, and 5E) including a detonating cord slot 411 of a first shaped charge 113, i.e., the shaped charge 113 nearest the control module section 130, via a guiding slot 310 formed as a radial cutaway in the conversion region 330. The conversion region 330 in the exemplary embodiment shown in FIG. 4 is positioned between, and is integral with, each of the perforating assembly section 110 and the control module section 130. As noted previously in this disclosure, the perforating assembly section 110 and the control module section 130 are generally defined with respect and reference to the position and configuration of certain structures and componentry and for aiding the description of an exemplary bottom-fire perforating drone according to this disclosure. For example, the perforating assembly section 110 in the exemplary embodiment shown in FIG. 4 is generally the length L of the bottom-fire perforating drone 100 along which the shaped charges 113 are positioned and the control module section 130 is the length M of the bottom-fire perforating drone 100 along or within which, without limitation, control components (e.g., the control module 137) and initiation components (e.g., the detonator 133, the donor charge 134, the ballistic interrupt 140, and the receiver booster 150) are positioned. The conversion region 330 in the exemplary embodiment shown in FIG. 4 joins and transitions a configuration of the control module section 130 on a first side 331 of the conversion region 330 to a configuration of the perforating assembly section 110 on a second side 332 of the conversion region 330.

Figure 5A:
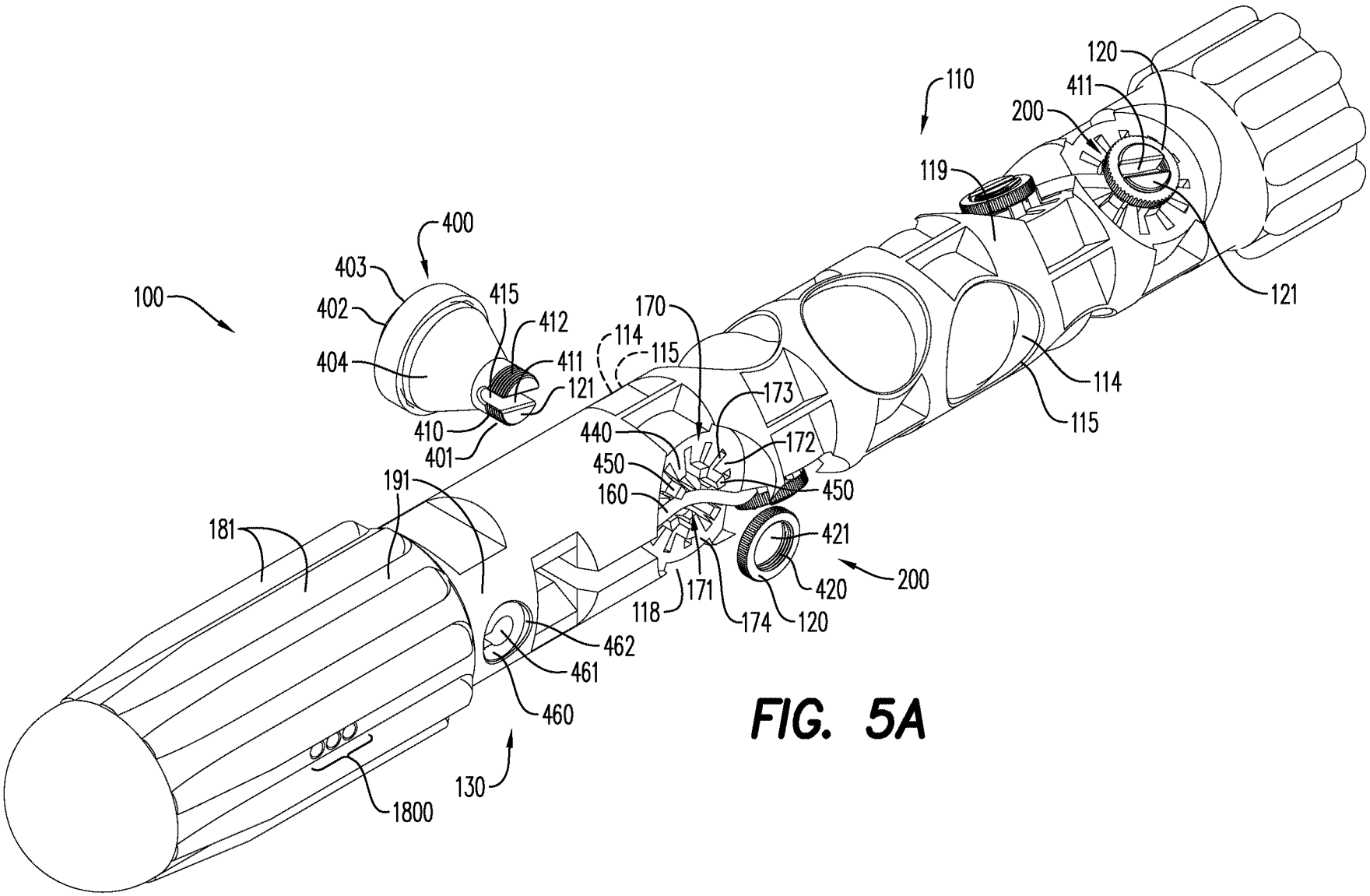
FIG. 5A is a perspective view with an exploded view of a shaped charge and a fixation connector of the exemplary embodiment according to FIG. 2B.
Figure 5B:
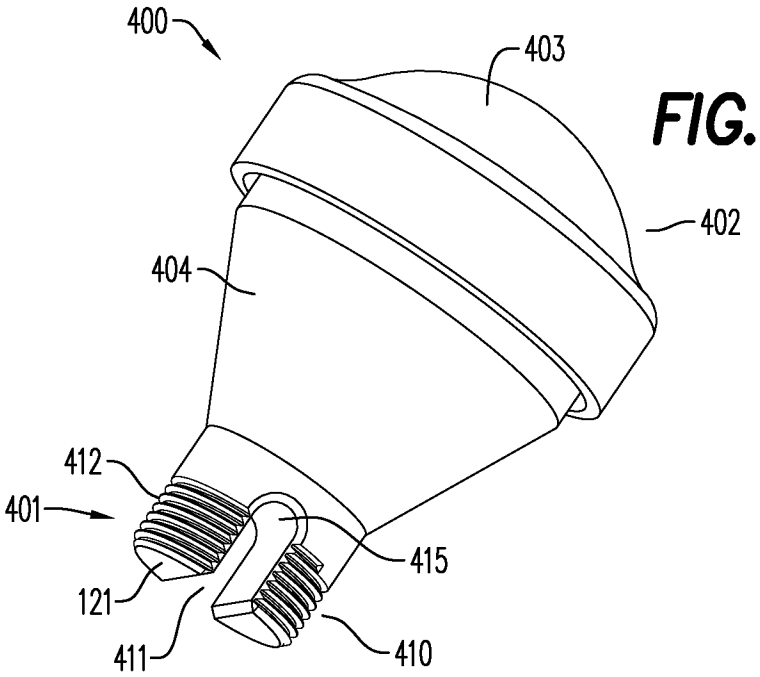
FIG. 5B shows the exemplary shaped charge for use with the exemplary fixation connector according to FIG. 5A.
Figure 5C:
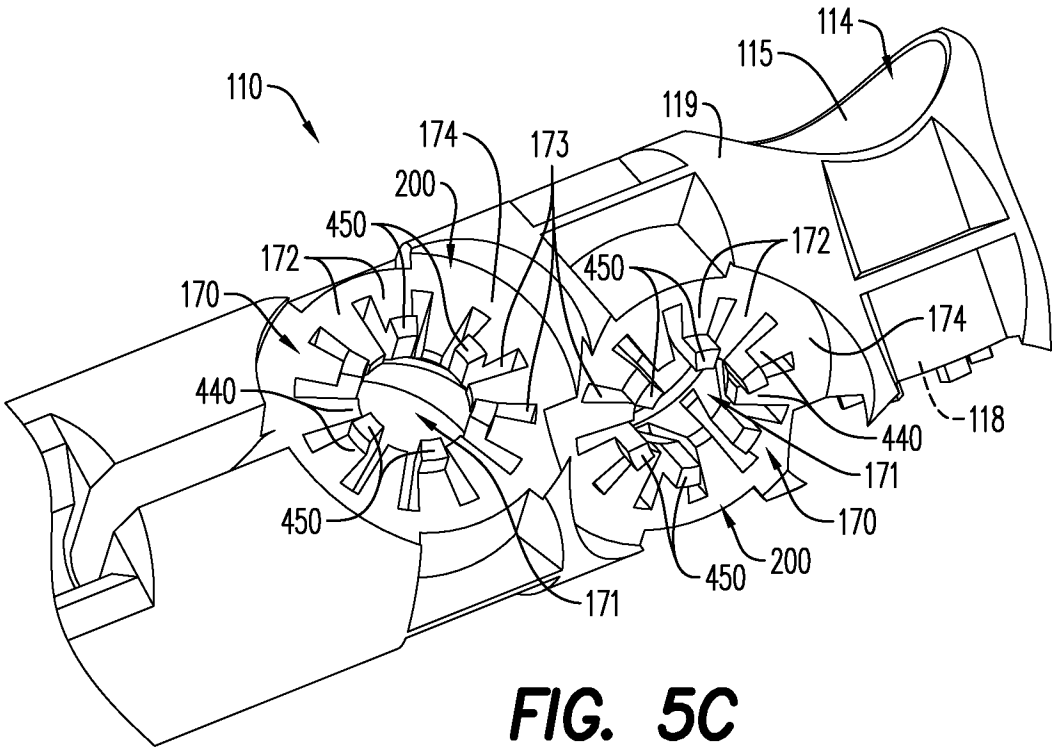
FIG. 5C shows the exemplary fixation connector according to FIG. 5A, in a first state of assembly.
Figure 5D:
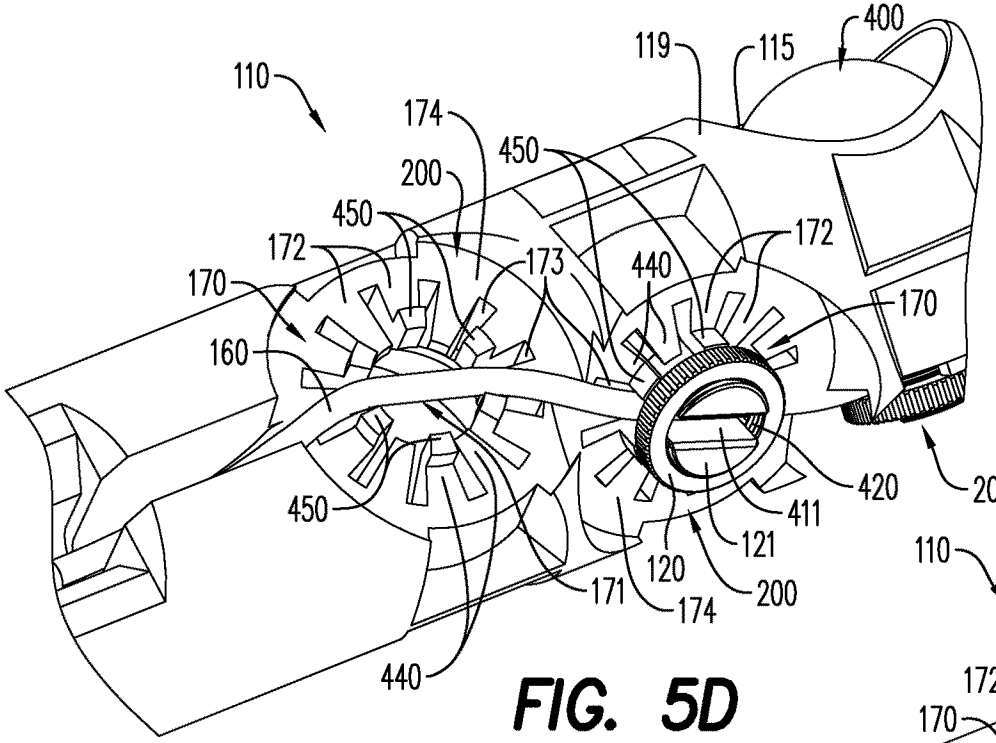
FIG. 5D shows the exemplary fixation connector according to FIG. 5A, in a second state of assembly.
Figure 5E:
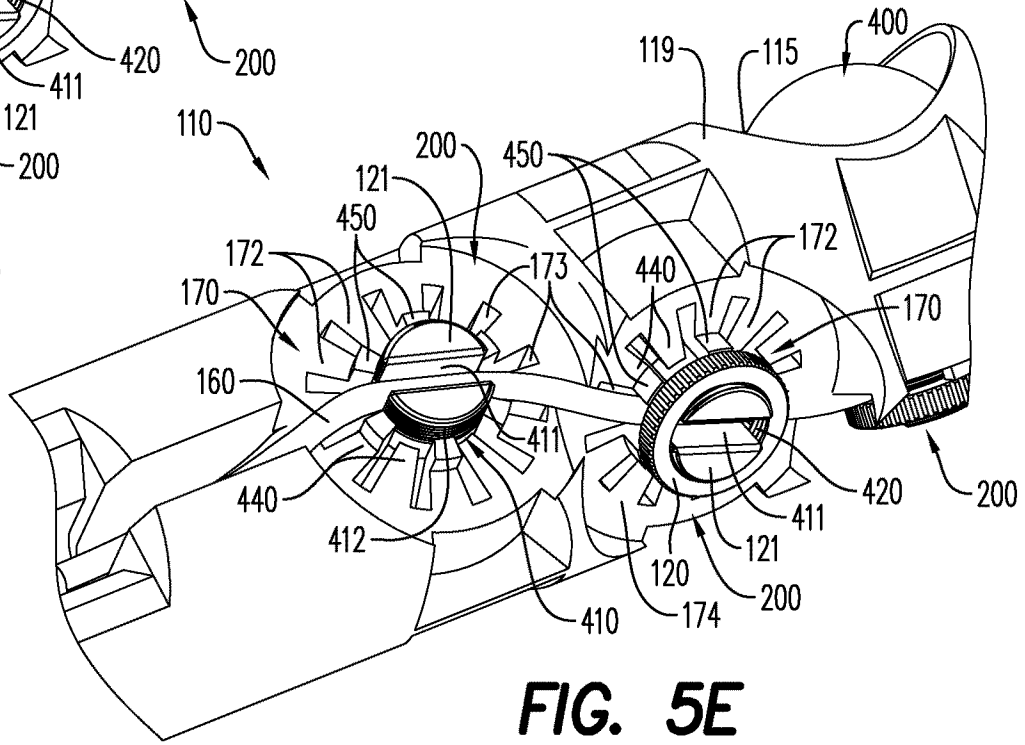
FIG. 5E shows the exemplary fixation connector according to FIG. 5A, in a third state of assembly.

With reference now to FIGS. 5A-5E, a shaped charge 400 and the fixation assembly 200 for retaining the shaped charge 400 in the perforating assembly section 110 according to an exemplary embodiment are shown. FIG. 5A shows a breakout of the shaped charge 400 and a fixation connector 120 (described below) from the exemplary bottom-fire perforating drone 100 and fixation assembly 200 as shown and described with respect to FIGS. 2A-4. FIG. 5B shows the exemplary shaped charge 400 for use in the embodiment shown in FIG. 5A. FIGS. 5C-5E show blown-up views of the exemplary fixation assemblies 200 in various stages of assembly with the exemplary shaped charge 400 and detonating cord 160.

With particular reference to FIG. 5A and FIG. 5B, the exemplary shaped charge 400 includes, among other things, an initiation side 401 at which the detonating cord 160, for example, will attach to detonate the shaped charge 400, and an encapsulated side 402 opposite the initiation side 401 and including a cap 403 for enclosing explosive and/or kinetic materials (not shown) within a casing 404 of the shaped charge 400, as is well known in the art. The exemplary shaped charges 400 include a cap 403 because the shaped charges 113, 400 in the disclosed exemplary embodiments of a bottom-fire perforating drone 100 are exposed—i.e., they are not otherwise isolated from wellbore conditions by a structure of the bottom-fire perforating drone 100. Wellbore fluids and conditions may be corrosive, excessively hot and high pressure, turbulent, and/or otherwise damaging to the shaped charges 113, 400, especially in the event that wellbore fluid or high pressures permeate into the shaped charge casing 404. Encapsulated shaped charges are generally known for such exposed applications. However, in various embodiments consistent with this disclosure, a bottom-fire perforating drone may have a configuration for enclosing associated shaped charges and thereby obviating the need for encapsulated shaped charges.

Continuing with reference to FIG. 5A and FIG. 5B, the connecting portion 410 of the exemplary shaped charge 400 is positioned at the initiation side 401 of the shaped charge 400 and may be integrally formed with the casing 404 as a projection therefrom. The exemplary connecting portion 410 shown in FIG. 5A and FIG. 5B is configured generally as a cylinder with the detonating cord slot 411, i.e., a parabolic void, extending between a bottom surface 121 of the connecting portion 410 and a detonating cord seat 415 within the cylinder. The detonating cord slot 411 and the detonating cord seat 415 may be shaped complimentarily to the detonating cord 160 or may include any configuration consistent with retaining and guiding the detonating cord 160 between shaped charges 400 along the length L of the bottom-fire perforating drone 100, as described herein.

With additional reference now to FIGS. 5C-5E, the shaped charge 400 and the connecting portion 410 are configured and sized such that the connecting portion 410 and an external threaded portion 412 of the connecting portion 410 protrude from a central aperture 171 of the fixation assembly 200 when the shaped charge 400 is received in the aperture 114 through the perforating assembly section 110. In the exemplary embodiments shown in FIGS. 5A and 5C-5E, the central aperture 171 defines, in part, the second opening 116 of the aperture 114 through the perforating assembly section 110. This configuration provides a connection area for the fixation connector 120 to engage the connecting portion 410 of the shaped charge 400 and clamp, compress, or otherwise secure the connecting portion 410 at the second opening 116, thereby securing, at least in part, the shaped charge 400 in the aperture 114. In the exemplary embodiment shown in FIGS. 5A, 5D, and 5E, the fixation connector 120 is an annular, female connector with a threaded inner surface 420 and an annular opening 421. The threaded inner surface 420 of the fixation connector 120 is complimentary to the external threaded portion 412 of the connecting portion 410 of the shaped charge 400, for threadingly engaging the external threaded portion 412 of the connecting portion 410 when the connecting portion 410 is received within the annular opening 421 of the fixation connector 120. The fixation connector 120 may then be threadingly advanced along the external threaded portion 412 of the connecting portion 410 until, e.g., it reaches and begins to compress against an opposing surface or structure of the fixation assembly 200. In the exemplary embodiment shown in FIGS. 5A and 5C-5E, the opposing structure includes a plurality of teeth 450 extending outwardly from a star-shaped plate 170 that will be further described with respect to the fixation assembly 200. However, the fixation assembly 200 is not limited by the disclosed geometries or configurations. In various embodiments (see, e.g., FIGS. 10B-15), other known compression, connection, or retention devices and techniques including, without limitation, clamps, clasps, screws, nuts, ratcheting connectors, straps, bands, tape, rubber rings and the like may be used to fixate various exemplary shaped charges, in various exemplary bottom-fire perforating drone assemblies. Further, the mechanisms, structures, and components of a particular fixation assembly may be separate or may be integrally formed with each other and/or the perforating assembly section body 119 as, for example, features of a single injection-molded piece.

With continuing reference to FIGS. 5A and 5C-5E, the star-shaped plate 170 in the exemplary fixation assembly 200 is integrally formed with the perforating assembly section body 119, as a feature thereof. For example, the star-shaped plate 170 is a generally circularly-shaped surface feature on the second side 118 of the perforating assembly section body 119 with respect to, and opposite, the first opening 115 of a corresponding aperture 114 through the perforating assembly section 110, with which the star-shaped plate 170 is concentrically aligned. In an aspect, the star-shaped plate 170 may be a terminus of the aperture 114.

The star-shaped plate 170 is defined in part by an outer ring portion 174 from which a plurality of fingers 172 extend radially inwardly between the outer ring portion 174 and respective end portions 440 of each finger 172. The end portions 440 are collectively positioned about the central aperture 171 in the star-shaped plate 170 and thereby define the central aperture 171. The central aperture 171 extends laterally (e.g., along the axis y) through the star-shaped plate 170 between an outside of the bottom-fire perforating drone 100 and an interior (not numbered) of the aperture 114 through the perforating assembly section 110. A plurality of gaps 173 extend radially outwardly from the central aperture 171 such that the fingers 172 and the gaps 173 are alternatingly arranged about a circumference of the central aperture 171, thus creating the so-called "star-shaped" feature.

The end portions 440 of some of the fingers 172 collectively include the plurality of teeth 450 that form a compression surface for the fixation connector 120 as described further herein with respect to an exemplary practice of the bottom-fire perforating drone 100. Each of the teeth 450 is a projection that is connected to, or integral with, a respective end portion 440 and extends away from the end portion 440 at about a 90-degree angle to the finger 172, in a direction away from the longitudinal axis x of the bottom-fire perforating drone 100. Thus, the plurality of teeth 450 will extend along at least a portion of the connecting portion 410 of the shaped charge 400 that protrudes from the central aperture 171 of the star-shaped plate 170 when the shaped charge 400 is retained in the aperture 114 through the perforating assembly section 110.

In an exemplary practice of the bottom-fire perforating drone 100, each shaped charge 400 may be connected to the exemplary bottom-fire perforating drone 100 by inserting the shaped charge 400 into the corresponding aperture 114 through the perforating assembly section 110. When the shaped charge 400 is fully received in the aperture 114 the connecting portion 410 including the external threaded portion 412 and the detonating cord slot 411 protrudes from the central aperture 171 in the star-shaped plate 170, as described. The detonating cord 160 may then be inserted into the detonating cord slot 411, down to the detonating cord seat 415, and the fixation connector 120 may be threaded onto and advanced along the connecting portion 410 until it reaches the plurality of teeth 450, against which it will compress and retain the shaped charge 400 and the detonating cord 160. The exemplary configuration of the plurality of teeth 450 shown in FIGS. 5A and 5C-5E elevates the fixation connector 120 above the detonating cord 160 within the detonating cord slot 411 such that the fixation connector 120 may be sufficiently compressed against the plurality of teeth 450 to secure the shaped charge 400 without crushing the detonating cord 160. Further, the compression is enhanced because the teeth 450 are positioned on the fingers 172 which have additional resiliency and may conform to oppose specific forces created by the fixation connector 120.

The configuration also allows the detonating cord 160 to extend along the length L of the perforating assembly section 110 through spaces (not numbered) created between the plurality of teeth 450 by end portions 440 that do not include teeth 450. In addition, the shaped charge 400 may be oriented (e.g., turned) within the aperture 114 such that the detonating cord slot 411 is oriented to direct the detonating cord 160 towards a subsequent shaped charge 400 on the perforating assembly section 110. In the exemplary embodiment shown in FIG. 5A, the shaped charges 400 are arranged in a helical pattern along the length L, and the detonating cord 160 follows the helical pattern and connects to each of the shaped charges 400. The detonating cord 160 in the assembled fixation assembly 200 is held in sufficient contact, communication, or proximity with the initiation end 401 of the shaped charges 400 such that the detonating cord 160 is energetically coupled to the initiation end 401 of each shaped charge 400 so as to detonate the explosive charge within the casing 404, as is well known in the art.

While the shaped charge apertures 114 (and correspondingly, the shaped charges 113, 400) are shown in a typical helical arrangement about the perforating assembly section 110 in the exemplary embodiment shown in FIGS. 2A-5E, the disclosure is not so limited and it is contemplated that any arrangement of one or more shaped charges may be accommodated, within the spirit and scope of this disclosure, by the exemplary bottom-fire perforating drone 100. For example, a single shaped charge aperture or a plurality of shaped charge apertures for respectively receiving a shaped charge may be positioned at any phasing (i.e., circumferential angle) on the body portion, and a plurality of shaped charge apertures may be included, arranged, and aligned in any number of ways. For example, and without limitation, the shaped charge apertures 114 may be arranged, with respect to the body portion, along a single longitudinal axis, within a single radial plane, in a staggered or random configuration, spaced apart along a length of the body portion, pointing in opposite directions, and the like.

In the exemplary embodiments, the bottom-fire perforating drone 110 including the perforating assembly section body 119, the control module section body 191, the tip section 195, and the tail section 180 may be formed from a material that will substantially disintegrate upon detonation of the shaped charges 113. In an exemplary embodiment, the material may be an injection-molded plastic that will substantially dissolve into a proppant when the shaped charges 113 are detonated, and the bottom-fire perforating drone 100 may be an integral unit. In the same or other embodiments, one or more portions of the bottom-fire perforating drone 100 may be formed from a variety of techniques and/or materials including, for example and without limitation, injection molding, casting (e.g., plastic casting and resin casting), metal casting, 3D printing, and 3D milling from a solid plastic bar stock. Reference to the exemplary embodiments including injection-molded plastics is thus not limiting. Further, as noted herein, the description of particular sections and portions of a bottom-fire perforating drone 100 are for aiding the disclosure with respect and reference to the position of various components, and forming the bottom-fire perforating drone 100, for example, with one or a combination of integral and separate elements, may be done as applications dictate, without limitation based on the disclosed sections and portions of a bottom-fire perforating drone 100.

For example, the bottom-fire perforating drone 100 may be formed as an integral unit, and a portion such as the tip section 195 according to this disclosure may then be removed and adapted for re-securing to the bottom-fire perforating drone 100, to allow the bottom-fire perforating drone 100 to, e.g., be transported without a detonator assembly (such as in the control module 137) according to applicable regulations. Once on site, the control module 137 may be inserted into, e.g., the control module section 130 according to this disclosure, and the tip section 195 re-secured thereto. The tip section 195 may be adapted for re-securing to the control module section 130 by milling, turning or injection molding complementary threaded portions, click slots or a bayonet key-turn in each, or using other techniques as known. The connection between the tip section 195 and the control module section is further shown and discussed with respect to FIG. 12. In another aspect, the control module 137 may be preassembled in the control module section 130, before transport, as applicable regulations and applications allow.

A bottom-fire perforating drone 100 formed according to this disclosure leaves a relatively small amount of debris in the wellbore post perforation. In some embodiments, at least a portion of the bottom-fire perforating drone 100 may be formed from plastic that is substantially depleted of other components including metals. Substantially depleted may mean, for example and without limitation, lacking entirely or including only nominal or inconsequential amounts. In some embodiments, the plastic may be combined with any other materials consistent with this disclosure. For example, the materials may include metal powders, glass beads or particles, known proppant materials, and the like that may serve as a proppant material when the shaped charges 113 are detonated. In addition, the materials may include, for example, oil or hydrocarbon-based materials that may combust and generate pressure when one or more of the detonator 133, the donor charge 134, and the shaped charges 113 are detonated, synthetic materials potentially including a fuel material and an oxidizer to generate heat and pressure by an exothermic reaction, and materials that are dissolvable in a hydraulic fracturing fluid.

In some embodiments, the exemplary bottom-fire perforating drone 100 may be connected at the tail portion 180 to a wireline that extends to the surface of the wellbore. The wireline may be connected to the bottom-fire perforating drone by any known technique for connecting a wireline to a wellbore tool. The wireline may further assist in retrieving any components of the bottom-fire perforating drone, including, without limitation, a control module, data collection device, or other portions that remain in the wellbore post detonation/perforation. The remaining components may be retracted to the surface along with the wireline.

In an exemplary operation, one or more bottom-fire perforating drones 100 according to the disclosed embodiments are connected to a control system at the surface of a wellbore. The bottom-fire perforating drones 100 may be manually connected to the control system, or loaded into, for example and without limitation, a deployment vehicle, pressure equalization chamber, or other system for deploying the bottom-fire perforating drones 100 into the wellbore and including an appropriate connection to the control system. The control system may perform, among other things, a safety check and function test on each bottom-fire perforating drone 100. Upon a successful result from any test for safety, function, compliance, and/or otherwise, the control system or an operator may "arm" the bottom-fire perforating drone 100 by moving the ballistic interrupt 140 to an open state 144, as described. The control system may also record which bottom-fire perforating drones 100 have been armed and determine the order in which the respective bottom-fire perforating drones 100 will be deployed. The control system may communicate the order, and other instructions, to the bottom-fire perforating drone 100 via an electrical connection to the control assembly 131, e.g., the programmable electronic circuit, of each bottom-fire perforating drone 100 as described. Other instructions may include, without limitation, a threshold depth at which to send a detonation signal to the detonator 133, a time delay or other instructions for arming a trigger circuit, desired data to transmit to the wellbore surface, or other instructions that a control system may provide as discussed in United States Provisional Patent Application Nos. 62/690,314 filed Jun. 26, 2018 and 62/765,185 filed Aug. 20, 2018, both of which are incorporated herein by reference in their entirety.

In the exemplary embodiments, the control assembly 131 includes, without limitation, a depth correlation device, and the programmable electronic circuit is either pre-programmed, or programmed via the control system, to receive from the depth correlation device data regarding the current depth of the bottom-fire perforating drone 100 within the wellbore and send a detonation signal to the detonator 133 when the bottom-fire perforating drone 100 reaches a predetermined depth. The depth correlation device may be, for example, an electromagnetic sensor, an ultrasonic transducer, or other known depth correlation devices consistent with this disclosure. The bottom-fire perforating drone 100 may also include a velocity sensor for measuring a current velocity of the bottom-fire perforating drone 100 within the wellbore, or the depth correlation device may include a velocity sensor or calculate a velocity based on sequential depth readings, and the programmable electronic circuit may be programmed to receive such velocity data as part of a criteria for transmitting the detonation signal.

In some embodiments, the bottom-fire perforating drone 100 may work with other systems, such as radio-frequency (RF) transducers, casing collar locators (CCL), or other known systems for determining a position of a wellbore tool within the wellbore.

With reference again to the exemplary embodiments, after being deployed into the wellbore the depth correlation device measures the depth of the bottom-fire perforating drone 100 within the wellbore. When the bottom-fire perforating drone 100 reaches the predetermined depth, the programmable electronic circuit sends a detonation signal to the detonator 133, which initiates detonation of the donor charge 134 and ultimately the shaped charges 113, as described. The programmable electronic circuit may be in wired, wireless, or contactable electrical communication with the detonator 133 by various known techniques, or may send the detonation signal via, or after activating, e.g., a trigger circuit or other intervening detonation component. The detonation signal may be, without limitation, a selective sequence signal, as previously discussed, that is unique to the detonator 133 of the particular bottom-fire perforating drone 100. The selective detonation signal may provide a safety measure against accidental firing by, for example, external RF signals.

As described, the bottom-fire perforating drone 100 travels through the wellbore with the tip section 195 downstream, and the detonating cord 160 is initiated by the receiver booster 150 at the downstream end 111 of the perforating assembly section 110. Accordingly, the ballistic/thermal release from the detonating cord 160 propagates along the length L of the perforating assembly section 110 in a direction from the downstream end 111 of the perforating assembly section 110 to the upstream end of the perforating assembly section 110, and the shaped charges 113 are correspondingly detonated (by the detonating cord 160) in a bottom-up, i.e., downstream to upstream, sequence. This bottom-up sequence for detonating the shaped charges 113 prevents downstream shaped charges and portions of the bottom-fire perforating drone 100 from being separated and blown away from the rest of the assembly, as may happen if an upstream shaped charge is detonated while a drone is traveling at high velocity in a wellbore fluid. Accordingly, the bottom-up detonation sequence may prevent downstream shaped charges from failing to detonate or detonating at an undesired location, and leaving unexploded shaped charges and extra debris in the wellbore.

Figure 10A:
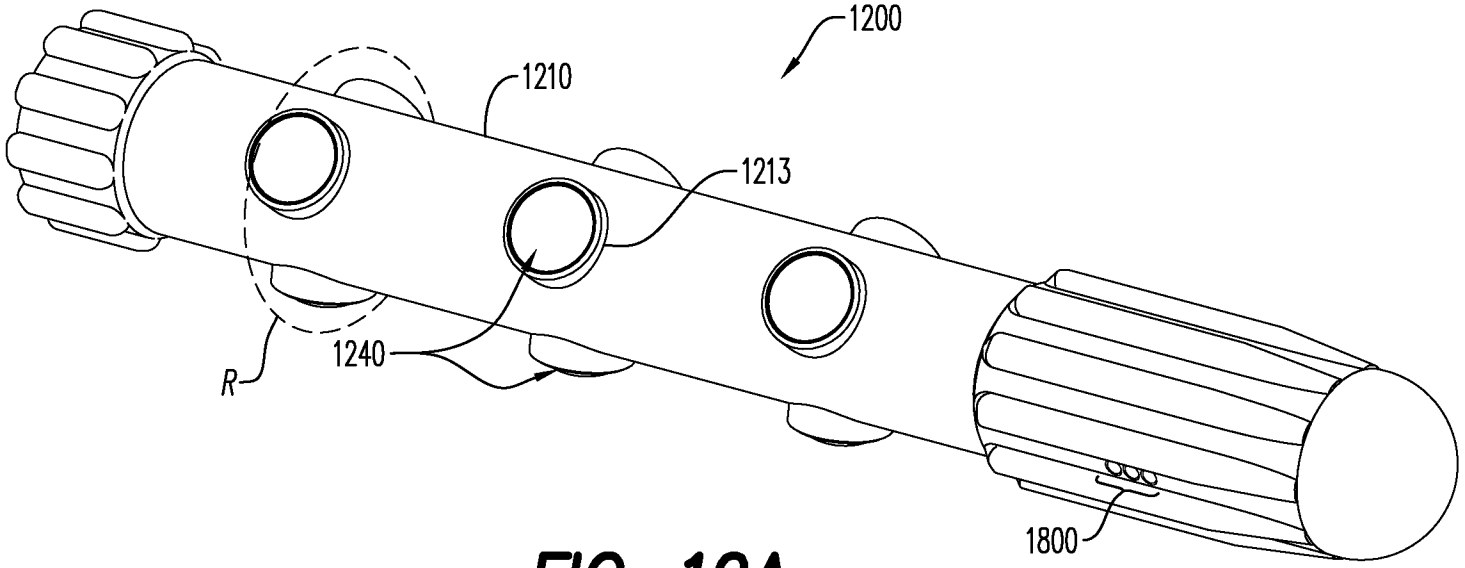
FIG. 10A is a perspective view of a bottom-fire perforating drone according to an exemplary embodiment.
Figure 10B:
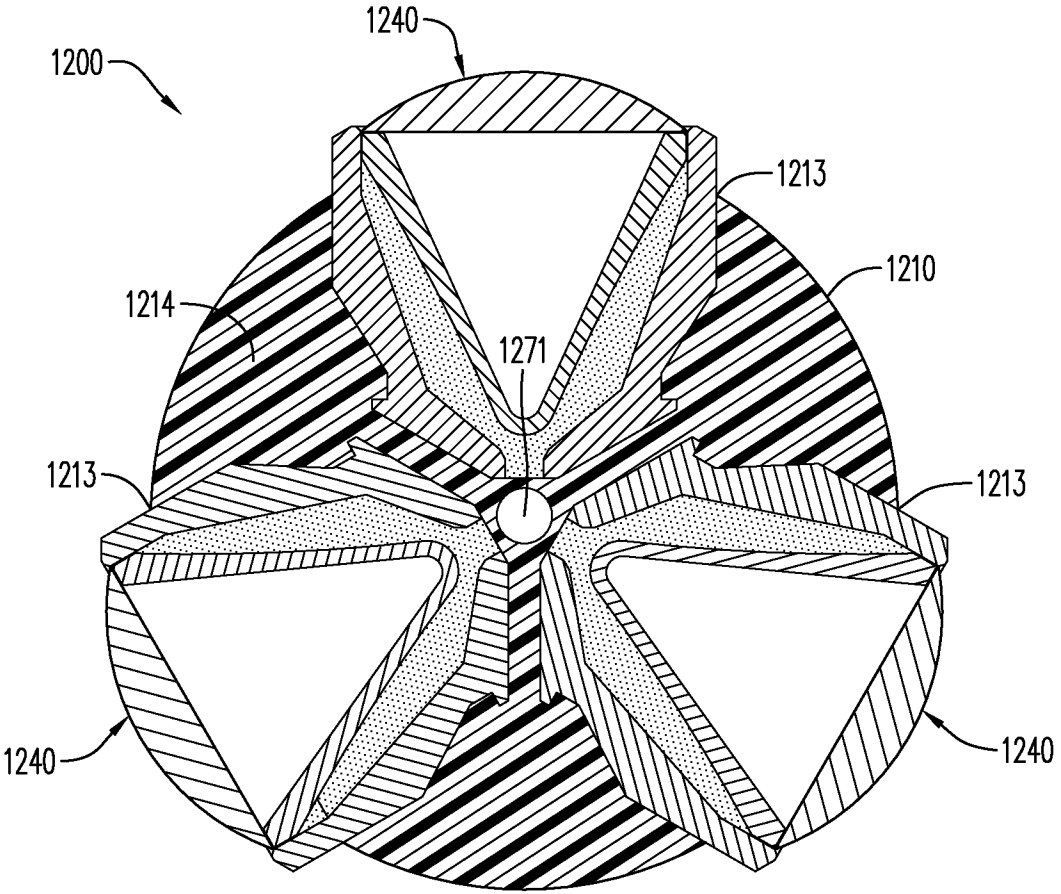
FIG. 10B is a lateral cross-sectional view of the bottom-fire perforating drone shown in FIG. 10A.

With reference now to FIGS. 10A and 10B, FIG. 10A shows a bottom-fire perforating drone 1200 according to an exemplary embodiment in which a plurality of shaped charges 1240 are arranged within one or more single radial planes R around a perforating assembly section body 1210 of the bottom-fire perforating drone 1200. Each of the shaped charges 1240 is received and retained in a corresponding shaped charge aperture 1213 at least in part within an interior 1214 of the perforating assembly section body 1210. FIG. 10B is a cross-sectional view showing the arrangement of the shaped charges 1240 and the shaped charge apertures 1213, among other things, within the interior 1214 of the perforating assembly section body 1210 of the exemplary bottom-fire perforating drone 1200 shown in FIG. 10A. In particular, FIG. 10B is a lateral cross-sectional view of the perforating assembly section body 1210 of the bottom-fire perforating drone 1200 shown in FIG. 10A taken along the radial plane R. For purposes of this disclosure, a radial plane is a plane generally containing each of a plurality of radii (e.g., shaped charges 1240) extending from a common center. The exemplary bottom-fire perforating drone 1200 shown in FIGS. 10A and 10B includes three shaped charges 1240 arranged in the same radial plane R and spaced apart by about a 120-degree phasing around the perforating assembly section body 1210. The type(s) of shaped charges used with an bottom-fire perforating drone as described throughout this disclosure are not limited and may include any shaped charges as are well-known and/or would be understood in the art and consistent with this disclosure. Exemplary embodiments of shaped charges for use with embodiments of a bottom-fire perforating drone and arrangement of shaped charges/shaped charge holders according to this disclosure, but not limited thereto, are shown and described with respect to FIGS. 10B-13B.

Figure 12:
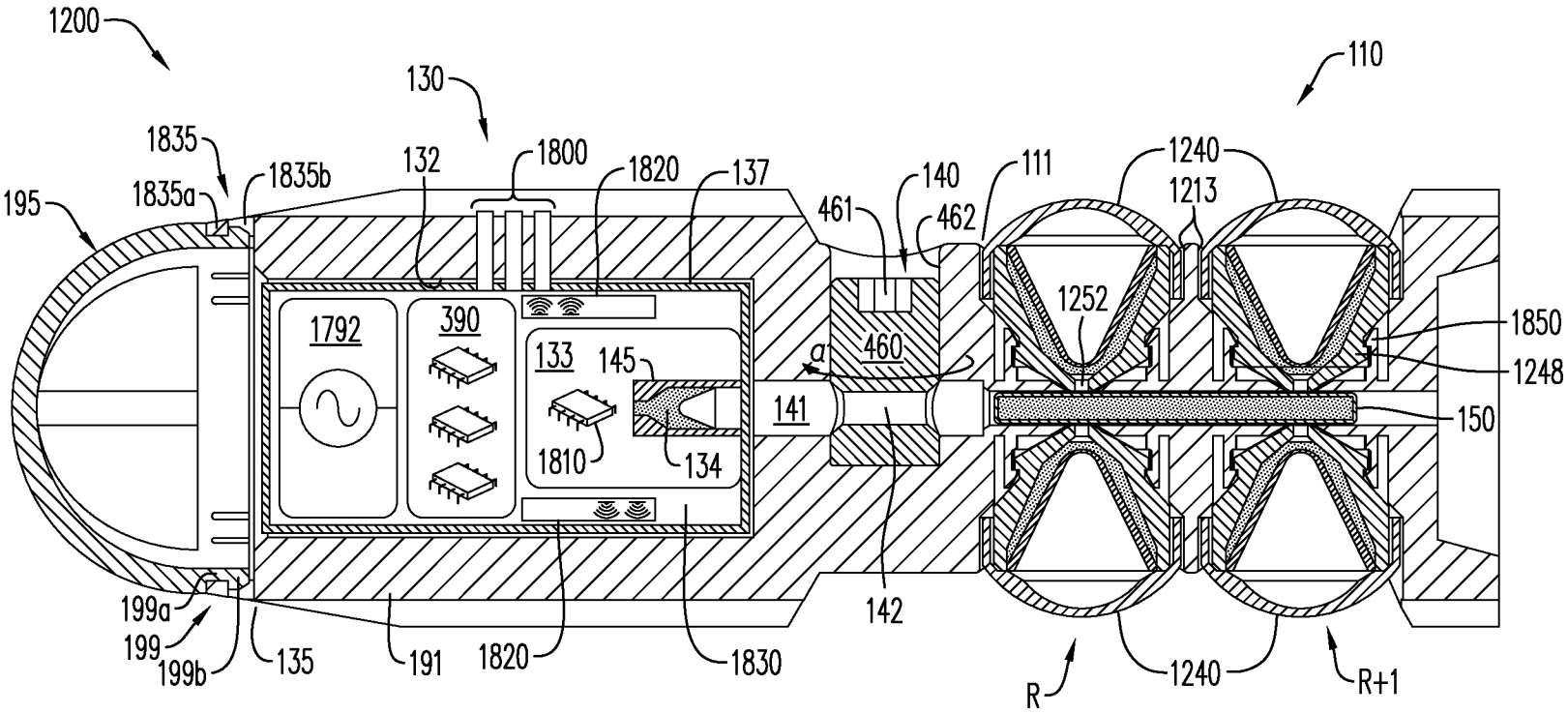
FIG. 12 is a cross-sectional view of a bottom-fire perforating drone according to an exemplary embodiment.

FIG. 10B also shows a detonator or booster 1271 positioned within the interior 1214 of the perforating assembly section body 1210 and adjacent to the shaped charges 1240 such that the shaped charges 1240 extend radially from the detonator 1271. In an aspect, the detonator 1271 may directly initiate detonation of the shaped charges 1240 upon detonation of the detonator 1271. In some embodiments, a detonation extender, such as a detonating cord or a booster device may also be secured in the interior 1214 of the perforating assembly section body 1210. The detonator extender may abut an end of the detonator 1271 or may be in side-by-side contact with at least a portion of the detonator 1271. The detonation extender may be in communication with the detonator 1271 such that upon activation of the detonator 1271 a detonation energy from the detonator 1271 simultaneously detonates the shaped charges in a first radial plane R and then initiates the detonation extender such that the detonation extender transfers a ballistic energy to detonate shaped charges arranged in a second, third, etc. radial plane R+1, R+2 (FIG. 12).

Figure 11:
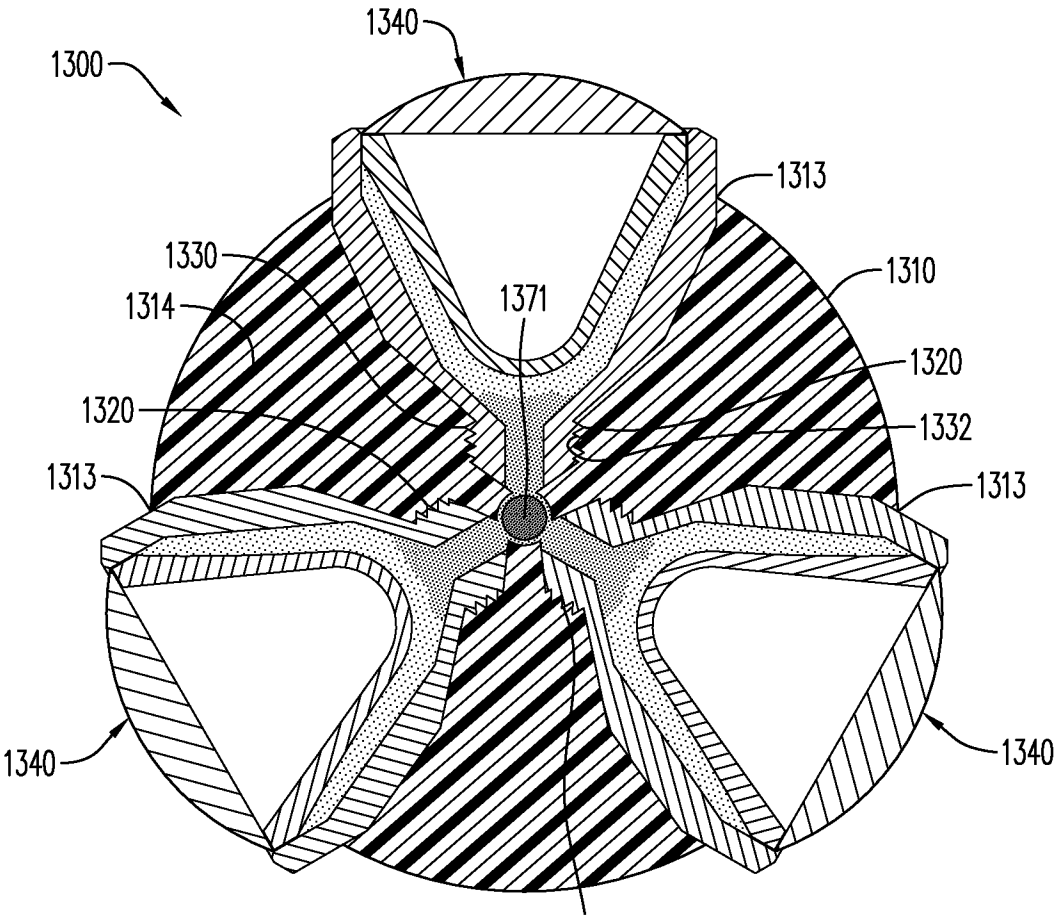
FIG. 11 is a lateral cross-sectional view of a bottom-fire perforating drone according to an exemplary embodiment.

With reference now to FIG. 11, an exemplary bottom-fire perforating drone 1300 according to some embodiments may include a threaded connection between a shaped charge 1340 and a shaped charge aperture 1313 in which the shaped charge 1340 is received. For example, FIG. 11 shows a lateral cross-sectional view taken along a radial plane of a body portion 1310 of the exemplary bottom-fire perforating drone 1300, similar to the lateral cross-sectional view shown in FIG. 10B. As shown in FIG. 11, the exemplary bottom-fire perforating drone 1300 includes three shaped charges 1340 arranged in the same radial plane and spaced apart by about a 120-degree phasing around the perforating assembly section body 1310. The shaped charges 1340 are respectively received and retained in the shaped charge apertures 1313 at least in part within an interior 1314 of the perforating assembly section body 1310. According to an aspect the shaped charge apertures 1313 include an internal thread 1320 for threadingly securing the shaped charge 1340 therein. The internal thread 1320 may be a continuous thread or interrupted threads that mate or engage with corresponding threads 1332 formed on a back wall protrusion 1330 of the shaped charge 1340. Other aspects of a configuration of a shaped charge for use with a bottom-fire perforating drone as described throughout this disclosure are not limited by this disclosure and may include a shaped charge having any configuration as is well-known and/or would be understood in the art and consistent with this disclosure. For example, a shaped charge configuration in which a shaped charge casing houses one or more explosive loads and a liner atop the explosive loads for containing the explosive load(s) within the shaped charge and forming a perforating jet upon detonating the shaped charge.

In the exemplary configuration shown in FIG. 11, a detonator 1371 (and/or optionally, a detonating cord) is positioned within the interior 1314 of the perforating assembly section body 1310 and adjacent to the shaped charges 1340 such that the shaped charges 1340 extend radially from the detonator 1371. In an aspect, the detonator 1371 may directly initiate detonation of the shaped charges 1340 upon detonation of the detonator 1371. It is contemplated that at least one of the shaped charge apertures 1313 may be in open communication with a hollow portion of the interior 1314 of the perforating assembly section body 1310 in which the detonator 1371 and/or the detonating cord is positioned.

The arrangement of shaped charges within a single radial plane as shown in FIGS. 10A-11 is not limited to the embodiments depicted in those figures, nor is the disclosure of such arrangements limiting. For example, any number of charges capable of fitting around a circumference of a portion of a bottom-fire perforating drone according to this disclosure may be arranged within a single radial plane and respectively spaced apart at any desired phasing. In another non-limiting example, shaped charges in separate radial planes may be arranged in a staggered fashion such that the shaped charges overlap along a single radial plane. In addition, one or more of a detonator, selective detonator, detonating cord, and other internal components of a bottom-fire perforating drone may be included and configured as particular applications consistent with this disclosure dictate.

With reference now to FIG. 12, a partial cross-section view of an exemplary bottom-fire drone 1200 with charges arranged in a series of respective radial planes R, R+1, in accordance, at least in part, with the embodiment shown in FIG. 10A, is shown. As discussed throughout this disclosure, bottom-fire drone 1200 includes a control module section 130 positioned between and connected to each of a tip section 195 and a perforating assembly section 110. The control module section 130 in the exemplary embodiment shown in FIG. 12 is connected to the tip section 195 via complimentary engagement structures including a lip 1835 extending away from a first end 135 of the control module section 130 and a corresponding lip 199 formed on the tip section 195. The lip 1835 of the control module section 130 includes a tab 1835*a* extending inwardly (i.e., towards axis x) and a concave surface 1835*b* positioned between and connected to each of the tab 1835*a* and the control module section body 191. The lip 199 of the tip section 195 includes a notch 199*a* and a tongue 199*b* configured respectively to receive the tab 1835*a* of the lip 1835 of the control module section 130 and be received against the concave surface 1835*b* of the lip of the control module section 130. Tab 1835*a* thereby prevents lateral movement or disengagement of the tip section 195 by engaging each of the notch 199*a* and the tongue 199*b*.

In an aspect, one or both of the control module section body 191 (including the lip 1835) and the lip 199 of the tip section 195 may be formed from a material with sufficient flexibility and resiliency to allow engagement of the lip 1835 of the control module section 130 and the lip 199 of the tip section 195 to move under a force of pushing the tip section 195 and the control module section 130 together, thereby bringing the respective engagement structures into position, before returning the complimentary engagement portions into their set position providing engagement as described above. In an aspect, the tip section 195 may be formed from a material such as, but not limited to, a hard rubber. In a further aspect, the material is abrasion-resistant. The separable aspect of the tip section 195 and the control module section 130 may allow selective insertion of the control module 137 into the hollow interior 132 of the control module section 130. Other techniques and configurations for removably securing the tip section 195 to the control module section 130 include, without limitation, threaded engagements, dovetail arrangements, or other techniques as are known for removably securing structures.

In another aspect, the tip section 195 may be configured as a "frac ball" for sealing a corresponding "frac plug" downhole in the wellbore. For example, frac plugs are well known for isolating zones of a wellbore during perforation. One style of known frac plugs are configured as sealing elements with an open channel through the center of the plug such that the plug may be completely sealed by a frac ball that sets within the open channel. Sealing a zone currently undergoing perforation and fracking from downstream portions of the wellbore allows the fracking fluid to more efficiently achieve the pressures required for cracking hydrocarbon formations in the current zone because the fracking fluid does not lose pressure required to fill downstream portions of the wellbore. However, once the wellbore is ready for production, the frac balls must be drilled out of the frac plug openings to allow hydrocarbons to flow through the wellbore and to the surface.

In an aspect, the tip section 195 of the bottom-fire perforating drone may be configured dimensionally for use as a frac ball and formed from one or more materials such that the frac ball tip section will not be destroyed upon detonation of the bottom-fire perforating drone. The frac ball tip section may be retained to the control module section 130 by any known techniques including a threaded portion, clips, straps, friction fits, adhesives, retention in a cavity, or other techniques as described in or consistent with this disclosure. Upon detonation of the bottom-fire perforating drone, the frac ball tip section will release and travel downstream until it encounters and seals a frac plug. A drone for use with a frac ball tip section may be a bottom-fire perforating drone as described throughout this disclosure or may be a "dummy" drone, i.e., that does not carry perforating charges or other wellbore tools for performing a separate function in the wellbore. In either case, the control module 137 of the bottom-fire perforating (or dummy) drone may be made from standard metal and drilled out with the frac ball/plug, and the shaped charges may be formed at least in part from zinc to reduce debris. In addition, a bottom-fire perforating drone incorporating a tip section as a frac ball may be used in conjunction with a bottom-fire drone for deploying a frac plug, such that the frac plug drone is sent downhole, sets the plug, and the frac ball drone is sent in thereafter to provide the frac ball seal and potentially perforate the wellbore casing/hydrocarbon formation with shaped charges as discussed throughout this disclosure.

Continuing with reference to FIG. 12, an exemplary arrangement of components in the control module 137 is shown. In an aspect, the control module 137 includes a power source 1792 such as a battery or a capacitor as previously discussed. The power source 1792 may be used to power one or more of, among other things, an onboard computer 390 (i.e., control circuit(s)), sensors 1820 such as depth or velocity sensors, among others, as previously discussed, and detonator control electronics 1810 for, e.g., receiving and responding to selective detonation signals. Charging/programming contacts 1800 are electrically connected to one or more of, e.g., the power source 1792 and the onboard circuitry/sensors 390, 1820, 1810 and extend through the control module section body 191 for connecting to an external power/control source and respectively charging or programming components of the control module 137. In an aspect, the components of the control module 137 in the exemplary embodiment shown in FIG. 12 are potted in material 1830 in the control module 137 to further pressure-isolate the components from potentially detrimental influence of surrounding environmental conditions, such as those of the wellbore. Other pressure-isolation techniques for the components include, without limitation, covering, embedding, and/or encasing the components in an injection-molded or 3D-printed material, and the like. Exemplary materials may include, without limitation, polyethylene-, polypropylene-, and/or polyamide-compounds.

The control module section 137, as previously discussed, further includes a detonator 133 and a donor charge 134 positioned within a detonator channel 145 of the control module 137. The donor charge 134 is substantially aligned with a ballistic channel 141 in which a ballistic interrupt 140 is positioned in a spaced apart relationship between the donor charge 134 and a receiver booster 150. In the embodiment shown in FIG. 12, the receiver booster 150 extends along a length of the ballistic channel 141 that is adjacent to a plurality of shaped charges 113 arranged in respective single radial planes R, R+1 and thereby directly initiates the shaped charges 113 upon detonation of the receiver booster 150 in a manner as previously discussed with respect to, e.g., a detonator or a detonating cord.

The exemplary ballistic interrupt 140 is cylindrically-shaped and functions as previously described. For example, the ballistic interrupt 140 in FIG. 12 is shown in an open state, i.e., where the bottom-fire drone 1200 would be considered armed in the sense that the donor charge 134 and the receiver booster 150 are in ballistic communication through the through-bore 142. The ballistic interrupt 140 may be movable, as previously described, between a closed state and an open state by, e.g., rotating ballistic interrupt actuator 460 approximately 90 degrees in a direction a, or opposite direction, such that the through-bore 142 shown in FIG. 12 as concentric with ballistic channel 141 would resultingly have a configuration perpendicular to the ballistic channel 141 (or, into the page as in the view of FIG. 12), i.e., a closed state of the ballistic interrupt 140.

Figure 13B:
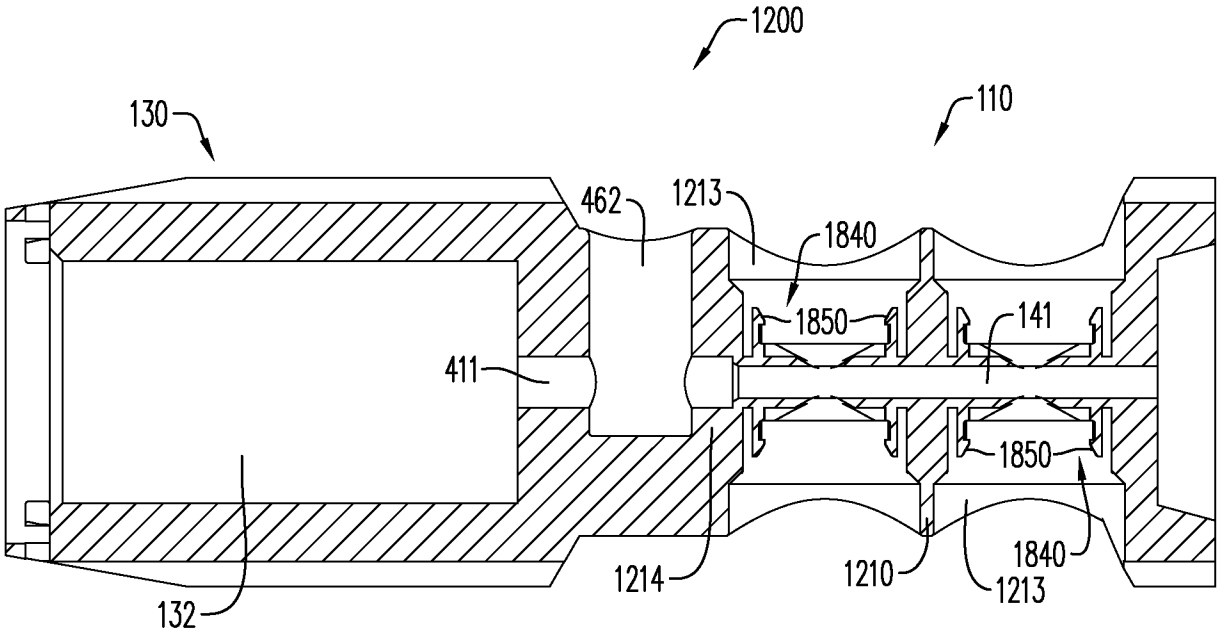
FIG. 13B is a cross-sectional view of the bottom-fire perforating drone according to FIG. 12, taken along the plane by view 'A' according to FIG. 13A.
Figure 13A:
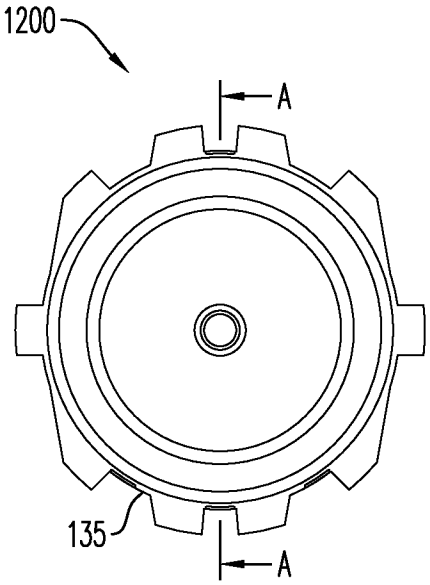
FIG. 13A is a plan view from the tip section of the exemplary bottom fire drone according to claim 12.

FIG. 13B shows a cross-section of the exemplary bottom-fire drone 1200 shown in FIG. 12 taken, according to FIG. 13A, along line A-A from the first end 135 of the control module section 130, and without the various internal components such that the internal configuration alone, including the hollow interior 132 of the control module section 130, the ballistic channel 141, the opening 462 for the ballistic actuator 460, and others as explained below, are illustrated.

With continuing reference to FIG. 12, and further reference to FIGS. 13B-15, an exemplary shaped charge 1240 as shown in FIG. 12 and for use in the arrangement of, e.g., FIG. 10B, although not limited thereto or restricted for use in that embodiment, is shown. As is well known for shaped charges, generally, and applicable commonly throughout this disclosure, the exemplary shaped charge includes a liner 1241 disposed adjacent an explosive load 1242. The liner 1241 is configured for retaining the explosive load 1242 within a cavity 1243 defined at least in part by a cylindrical sidewall 1244 including a first sidewall portion 1245 and a second sidewall portion 1246. A cap 1247 closes the shaped charge cavity 1243 from a surrounding environment as previously discussed with respect to known encapsulated shaped charges. In an aspect, the cap 1247 may not need to be crimped onto the sidewall 1244, due, for example, to the protection that the control module section 130 and tail section 180 provide against the shaped charges 1240 (i.e., caps 1247) impacting the wellbore casing. In another aspect, the cap 1247 may be formed from, without limitation, zinc, aluminum, steel, plastic, or other materials consistent with this disclosure.

In an aspect, the explosive load 1242 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), 2,6-Bis(picrylamino)-3,5-dinitropyridine/picrylaminodinitropyridin (PYX), hexanitrostibane (HNS), triaminotrinitrobenzol (TATB), and PTB (mixture of PYX and TATB). According to an aspect, the explosive load 1242 includes diamino-3,5-dinitropyrazine-1-oxide (LLM-105). The explosive load may include a mixture of PYX and triaminotrinitrobenzol (TATB). The type of explosive material used may be based at least in part on the operational conditions in the wellbore and the temperature downhole to which the explosive may be exposed.

Figure 14A:
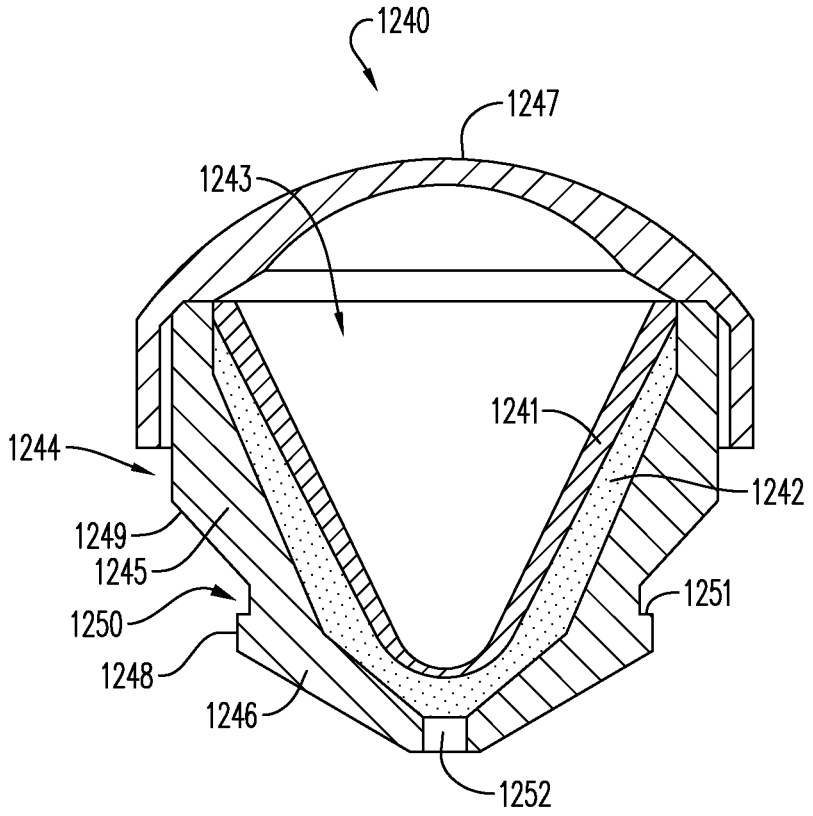
FIG. 14A shows an exemplary shaped charge for use with the exemplary bottom-fire perforating drone shown in FIG. 12.

In the exemplary embodiment shown in FIG. 14A, the liner 1241 has a conical configuration, however, it is contemplated that the liner 1241 may be of any known configuration consistent with this disclosure. The liner 1241 may be made of a material selected based on the target to be penetrated and may include, for example and without limitation, a plurality of powdered metals or metal alloys that are compressed to form the desired liner shape. Exemplary powdered metals and/or metal alloys include copper, tungsten, lead, nickel, bronze, molybdenum, titanium and combinations thereof. In some embodiments, the liner 1241 is made of a formed solid metal sheet, rather than compressed powdered metal and/or metal alloys. In another embodiment, the liner 1241 is made of a non-metal material, such as glass, cement, high-density composite or plastic. Typical liner constituents and formation techniques are further described in commonly-owned U.S. Pat. No. 9,862,027, which is incorporated by reference herein in its entirety to the extent that it is consistent with this disclosure. When the shaped charge 1240 is initiated, the explosive load 1242 detonates and creates a detonation wave that causes the liner 1241 to collapse and be expelled from the shaped charge 1240. The expelled liner 1241 produces a forward-moving perforating jet that moves at a high velocity.

Figure 14B:
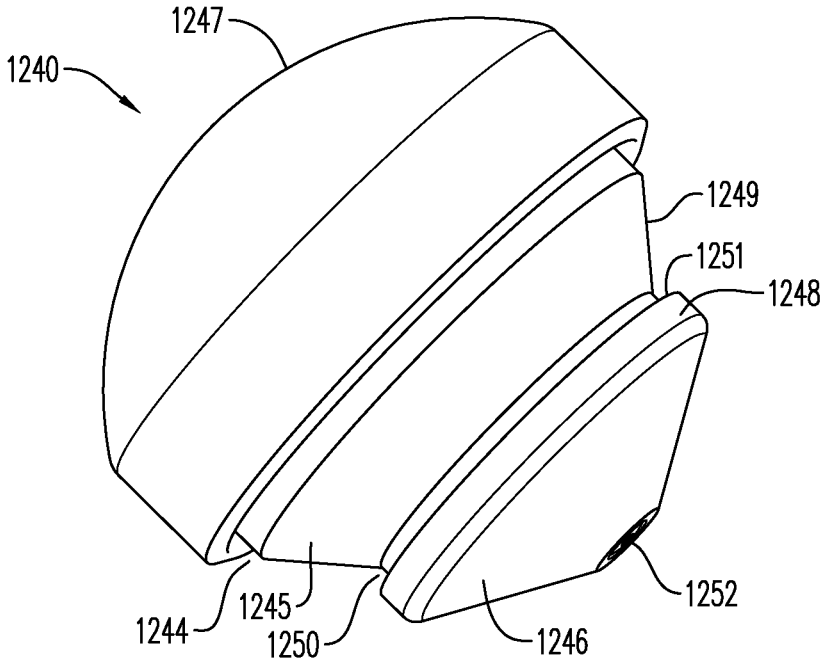
FIG. 14B shows a non-cross-sectional view of the exemplary shaped charge according to FIG. 14A; and, FIG. 15 shows a blown-up view of the shaped charges received in the exemplary perforating gun assembly section according to FIG. 12.

With continuing reference to FIGS. 12 and 14A-14B, an engagement member 1248 outwardly extends from an external surface 1249 of the side wall 1244 at a position substantially between the first sidewall portion 1245 and the second sidewall portion 1246. In an aspect, the engagement member 1248 may be configured for coupling the shaped charge 1240 within a shaped charge holder 1840 within an aperture 1213 at least partially within an interior 1214 of the perforating assembly section body 1210. In the exemplary embodiment, the engagement member 1248 at least in part defines a groove 1250 circumferentially extending around the side wall 1244. The groove 1250 defines a seat 1251 for engaging a retention device, such as one or more clips 1850 within the shaped charge holder 1840 for retaining the shaped charge 1240 within the shaped charge holder 1840. When the shaped charges 1240 are retained in the shaped charge holders 1840, an initiation point 1252 of each shaped charge 1240 is adjacent the ballistic channel 141 including, e.g., the receiver booster 150 for initiating detonation of the shaped charges 1240 in the exemplary embodiments.

Figure 15:
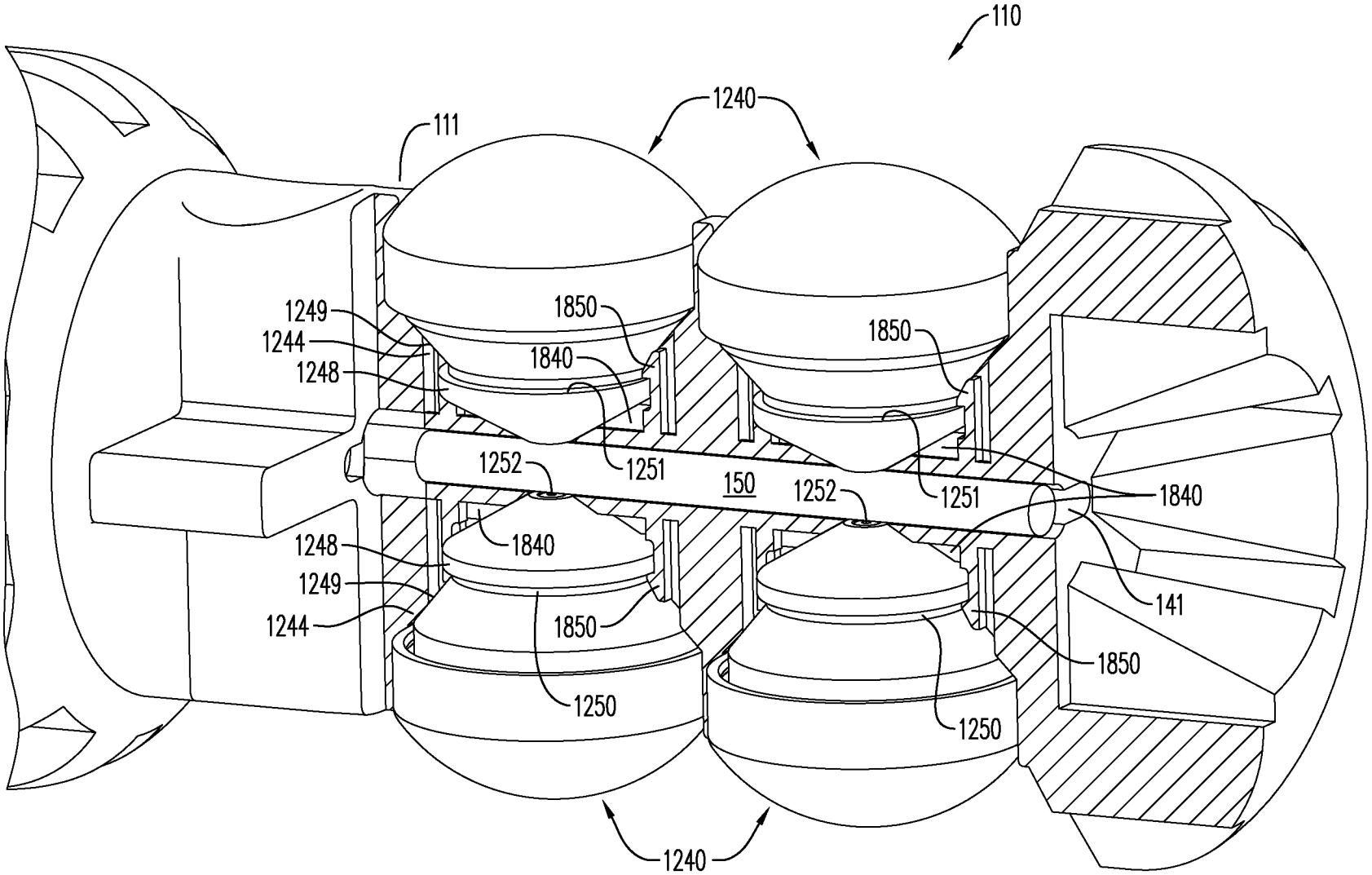

With reference now to FIG. 15, a blown-up view of the shaped charges 1240 received in the shaped charge holders 1840 according to FIGS. 12-14B is shown. When a shaped charge 1240 is received in a corresponding shaped charge holder 1840, clips 1850 engage against the seat 1251 formed on the groove 1250 defined by the engagement member 1248 extending outwardly from the external surface 1249 of the side wall 1244. As shown in FIG. 12, a receiver booster 150 is positioned within the ballistic channel 141 of the bottom-fire perforating gun 1200, adjacent to an initiation point 1252 of each shaped charge.

In an aspect, shaped charges arranged according to any of the exemplary embodiment(s) shown in FIGS. 10A-15 in which shaped charges are arranged adjacent to a detonator, receiver booster, donor charge, etc. in the absence or optional absence of a detonating cord, may be directly initiated by one or more of the adjacent detonator, receiver booster, donor charge, etc.

The exemplary embodiments presented herein may be used for deploying a variety of wellbore tools downhole, as previously discussed. Thus, neither the description nor the claims necessarily excludes the use of the bottom-fire perforating drone described throughout this disclosure of deploying a variety of wellbore tools for activation.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A perforating drone perforating a wellbore casing or hydrocarbon formation, comprising:

a perforating assembly section;

a control module section including a hollow interior portion and a ballistic channel respectively positioned within the control module section, wherein the ballistic channel extends from the hollow interior portion in a direction towards the perforating assembly section;

a control module positioned within the hollow interior portion of the control module section, wherein the control module includes a housing and the housing encloses a donor charge within an inner area of the control module, and the donor charge is positioned adjacent to the ballistic channel;

a receiver booster positioned within the ballistic channel; and, a ballistic interrupt positioned between the donor charge and the receiver booster in a spaced apart configuration from the donor charge and the receiver booster, wherein the ballistic interrupt is movable between a closed state and an open state, wherein the ballistic interrupt forms a physical barrier that prevents initiation of the receiver booster by the donor charge when the ballistic interrupt is in the closed state and the donor charge is in ballistic communication with the receiver booster when the ballistic interrupt is in the open state.

2. The perforating drone of claim 1, wherein the ballistic interrupt includes a through-bore, wherein the ballistic channel extends along a longitudinal axis of the bottom-fire perforating drone, the through-bore is not parallel to the longitudinal axis when the ballistic interrupt is in the closed state, and the ballistic interrupt is configured for preventing a perforating jet created by the donor charge from reaching the receiver booster when the ballistic interrupt is in the closed state, and the through-bore is parallel to the longitudinal axis and coaxial with the ballistic channel when the ballistic interrupt is in the open state.

3. The perforating drone of claim 1, wherein the perforating assembly section is configured for retaining a shaped charge within a first opening in the perforating assembly section.

4. The perforating drone of claim 3, wherein the first opening is a first opening of an aperture that extends through the perforating assembly section between the first opening on a first side of the perforating assembly section and a second opening on a second side of the perforating assembly section, wherein the second side is opposite the first side, and the shaped charge is retained within the first opening of the aperture by a fixation assembly connected to the shaped charge on the second side of the perforating assembly section.

5. The perforating drone of claim 4, further comprising a detonating cord connected to the receiver booster, wherein the fixation assembly is configured for energetically coupling the detonating cord to an initiation end of the shaped charge and guiding the detonating cord to a subsequent shaped charge in the perforating assembly section.

6. The perforating drone of claim 3, wherein at least a portion of the first opening in the perforating assembly section extends into an interior of a body portion of the perforating assembly section, wherein the portion of the first opening within the body portion of the perforating assembly section includes a threaded portion configured for threadingly engaging a corresponding threaded portion on an initiation side of the shaped charge, for retaining the shaped charge.

7. The perforating drone of claim 3, wherein at least a portion of the first opening in the perforating assembly section extends into an interior of a body portion of the perforating assembly section, wherein the portion of the first opening within the body portion of the perforating assembly section includes at least one retaining clip configured for engaging a corresponding groove on a sidewall of the shaped charge, for retaining the shaped charge.

8. The perforating drone of claim 1, further comprising a programmable electronic circuit and a detonator respectively positioned within the inner area of the control module, wherein the programmable electronic circuit is configured for receiving and updating information from a depth correlation sensor regarding the depth of the perforating drone within the wellbore and transmitting a detonation signal to the detonator when the perforating drone reaches a particular pre-programmed depth, and wherein the detonator and the donor charge are respectively positioned within a detonator channel, and the detonator is in ballistic communication with the donor charge, and the detonator is configured to detonate and thereby initiate the donor charge upon receiving the detonation signal.

9. The perforating drone of claim 1, further comprising a power supply positioned within the inner area of the control module or within the hollow interior of the control module section.

10. The perforating drone of claim 1, further comprising a plurality of shaped charges retained in shaped charge apertures in the perforating assembly section, wherein the control module section is positioned downstream of the perforating assembly section relative to an orientation of the drone when deployed in the wellbore.

11. The perforating drone of claim 1, further comprising a shaped charge retained in a shaped charge aperture in the perforating assembly section, wherein at least a portion of the shaped charge aperture is positioned within a body portion of the perforating assembly section, wherein the ballistic channel extends into the perforating assembly section such that at least a portion of the ballistic channel is adjacent to an initiation end of the shaped charge when the shaped charge is received within the shaped charge aperture, and the ballistic channel, the shaped charge aperture, and the shaped charge are together configured for direct initiation of the shaped charge by at least one of the receiver booster or a detonating cord positioned within the ballistic channel and a detonator positioned within the ballistic channel.

12. The perforating drone of claim 1, further comprising a plurality of shaped charges respectively received in corresponding shaped charge apertures, wherein at least a portion of each shaped charge aperture is positioned within a body portion of the perforating assembly section, wherein the shaped charge apertures are arranged in a single radial plane around the perforating assembly section, wherein the ballistic channel extends into the perforating assembly section such that at least a portion of the ballistic channel is adjacent to an initiation end of the shaped charges when the shaped charges are received within the shaped charge apertures, and the ballistic channel, the shaped charge apertures, and the shaped charges are together configured for direct initiation of the shaped charges by at least one of the receiver booster or a detonating cord positioned within the ballistic channel and a detonator positioned within the ballistic channel.

13. A method for perforating a wellbore casing or hydrocarbon formation, comprising:

arming a perforating drone, wherein the perforating drone includes a perforating assembly section, a control module section including a hollow interior portion and a ballistic channel respectively positioned within the control module section, wherein the ballistic channel extends from the hollow interior portion in a direction towards the perforating assembly section, a control module positioned within the hollow interior portion of the control module section, wherein the control module includes a housing and the housing encloses a detonator and a donor charge within a detonator channel within an inner area of the control module, wherein the detonator is in ballistic communication with the donor charge and configured to initiate the donor charge upon detonating, and the donor charge is positioned adjacent to the ballistic channel, a receiver booster positioned within the ballistic channel, a ballistic interrupt positioned within the ballistic channel between the donor charge and the receiver booster in a spaced apart configuration from the donor charge and the receiver booster, wherein the ballistic interrupt is movable between a closed state and an open state, wherein arming the perforating drone includes moving the ballistic interrupt from the closed state to the open state, and at least one shaped charge received in a shaped charge aperture in a body of the perforating assembly section;

deploying the perforating drone into the wellbore; and detonating the at least one shaped charge.

14. The method of claim 13, wherein the ballistic interrupt includes a through-bore, wherein moving the ballistic interrupt from the closed state to the open state includes moving the through-bore from an orientation that is perpendicular to a longitudinal axis of the ballistic channel to an orientation that is parallel to the longitudinal axis and coaxial with the ballistic channel.

15. The method of claim 14, wherein moving the ballistic interrupt from the closed state to the open state places the donor charge in ballistic communication with the receiver booster, via the through-bore.

16. The method of claim 13, wherein at least a portion of the shaped charge aperture is positioned within a body portion of the perforating assembly section, wherein the ballistic channel extends into the perforating assembly section such that at least a portion of the ballistic channel is adjacent to an initiation end of the shaped charge when the shaped charge is received within the shaped charge aperture, and the ballistic channel, the shaped charge aperture, and the shaped charge are together configured for direct initiation of the shaped charge by at least one of the receiver booster or a detonating cord positioned within the ballistic channel and a detonator positioned within the ballistic channel, and detonating the at least one shaped charge includes directly initiating the shaped charge with the at least one of the receiver booster, the detonator, and the detonating cord.

17. The method of claim 13, further comprising performing at least one of a function test and a safety check of the perforating drone, wherein arming the perforating drone is in response to a successful result of the at least one of the function test and the safety check.

18. The method of claim 13, wherein detonating the at least one shaped charge includes receiving and updating, at a programmable electronic circuit, information from a depth correlation sensor regarding the depth of the perforating drone within the wellbore and transmitting a detonation signal to the detonator when the perforating drone reaches a particular pre-programmed depth.

19. A perforating drone for perforating a wellbore casing or hydrocarbon formation, comprising:

a perforating assembly section;

a control module section including a hollow interior portion and a ballistic channel respectively positioned within the control module section, wherein the ballistic channel extends from the hollow interior portion into at least a portion of a body portion of the perforating assembly section;

a control module positioned within the hollow interior portion of the control module section, and a donor charge housed within the control module and aligned with the ballistic channel;

a receiver booster positioned at least in part within the portion of the ballistic channel within the body portion of the perforating assembly section;

a first plurality of shaped charges received in a first plurality of shaped charge apertures in the body portion of the perforating assembly section, wherein the first plurality of shaped charge apertures are arranged in a first single radial plane and an initiation end of each of the first plurality of shaped charges is adjacent to the receiver booster when the respective shaped charges are received in the respective shaped charge apertures;

a second plurality of shaped charges received in a second plurality of shaped charge apertures in the body portion of the perforating assembly section, wherein the second plurality of shaped charge apertures are arranged in a second single radial plane, wherein the second single radial plane is positioned upstream of the first single radial plane, and an initiation end of each of the second plurality of shaped charges is adjacent to the receiver booster when the respective shaped charges are received in the respective shaped charge apertures; and a ballistic interrupt positioned between the donor charge and the receiver booster in a spaced apart configuration from the donor charge and the receiver booster, wherein the ballistic interrupt is movable between a closed state and an open state, wherein the ballistic interrupt forms a physical barrier that prevents initiation of the receiver booster by the donor charge when the ballistic interrupt is in the closed state and the donor charge is in ballistic communication with the receiver booster when the ballistic interrupt is in the open state.

20. The perforating drone of claim 19, wherein the ballistic interrupt is rotatable between the closed state and the open state.

* * * * *